US007813670B2

(12) United States Patent
Matsuda

(10) Patent No.: US 7,813,670 B2
(45) Date of Patent: Oct. 12, 2010

(54) DEVELOPING CARTRIDGE, PROCESS CARTRIDGE, AND ELECTROPHOTOGRAPHIC IMAGE FORMING APPARATUS

(75) Inventor: Kenji Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/428,547

(22) Filed: Apr. 23, 2009

(65) Prior Publication Data

US 2010/0232832 A1 Sep. 16, 2010

(30) Foreign Application Priority Data

Mar. 11, 2009 (JP) ..... 2009-057447

(51) Int. Cl.
*G03G 21/16* (2006.01)

(52) U.S. Cl. ..... 399/111; 399/119

(58) Field of Classification Search ..... 399/111, 399/119

See application file for complete search history.

(56) References Cited

U.S. PATENT DOCUMENTS

| | | | | |
|---|---|---|---|---|
| 5,528,341 | A | 6/1996 | Shishido et al. | 355/200 |
| 5,642,187 | A | 6/1997 | Nomura et al. | 399/111 |
| 5,650,841 | A | 7/1997 | Matsuda et al. | 399/111 |
| 5,678,139 | A | 10/1997 | Nomura et al. | 399/114 |
| 5,697,022 | A | 12/1997 | Matsuda et al. | 399/102 |
| 5,825,472 | A | 10/1998 | Araki et al. | 355/200 |
| 5,867,751 | A | 2/1999 | Nomura et al. | 399/90 |
| 6,016,408 | A | 1/2000 | Hashimoto et al. | 399/27 |
| 6,101,352 | A | 8/2000 | Hashimoto et al. | 399/119 |
| 6,151,459 | A | 11/2000 | Hashimoto et al. | 399/27 |
| 6,272,300 | B1 | 8/2001 | Fujiwara et al. | 399/113 |
| 6,324,370 | B1 | 11/2001 | Isobe et al. | 399/258 |
| 6,564,029 | B2 | 5/2003 | Kojima et al. | 399/258 |
| 6,873,815 | B2 | 3/2005 | Matsuda et al. | 399/260 |
| 6,968,147 | B2 | 11/2005 | Matsuda et al. | 399/258 |
| 6,980,755 | B2 | 12/2005 | Numagami et al. | 399/109 |
| 7,200,350 | B2 | 4/2007 | Agata et al. | 399/223 |
| 7,242,888 | B2 | 7/2007 | Ishii | 399/110 |
| 7,277,659 | B2 | 10/2007 | Kobayashi et al. | 399/106 |
| 7,593,670 | B2 | 9/2009 | Matsuda et al. | 399/174 |

(Continued)

FOREIGN PATENT DOCUMENTS

JP 2001-117350 A 4/2001

(Continued)

*Primary Examiner*—David Gray
*Assistant Examiner*—Ryan D Walsh
(74) *Attorney, Agent, or Firm*—Fitzpatrick, Cella, Harper & Scinto

(57) ABSTRACT

A developing cartridge detachably mountable to an image forming apparatus main body having main body side guide portions and a cartridge mounting portion, including: a developer containing portion; a developing roller for developing a latent image formed on a photosensitive member with developer; first cartridge side guide portions provided at one end and the other end in a longitudinal direction of the roller, for engaging with the main body side guide portions to regulate a movement locus of the cartridge when the cartridge is mounted to the main body; and protruding portions provided at one end and the other end in the longitudinal direction, wherein the cartridge is mounted to the main body in a mounting direction orthogonal to the longitudinal direction with the roller being a leading edge, and the protruding portions protrude on a downstream side further than the roller in the mounting direction.

10 Claims, 19 Drawing Sheets

U.S. PATENT DOCUMENTS

| | | | | |
|---|---|---|---|---|
| 2003/0068173 | A1 * | 4/2003 | Tanizaki et al. | 399/119 |
| 2006/0153590 | A1 | 7/2006 | Igarashi | 399/116 |

FOREIGN PATENT DOCUMENTS

| | | |
|---|---|---|
| JP | 2004-301944 | 10/2004 |
| JP | 2005-091410 | 4/2005 |
| JP | 2006-189737 A | 7/2006 |

* cited by examiner

DEVELOPING CARTRIDGE, PROCESS CARTRIDGE, AND ELECTROPHOTOGRAPHIC IMAGE FORMING APPARATUS

BACKGROUND OF THE INVENTION

1. Field of the Invention

The present invention relates to an electrophotographic image forming apparatus to which developing cartridges are detachably mountable. Further, the present invention relates to an electrophotographic image forming apparatus to which process cartridges are detachably mountable.

Here, the electrophotographic image forming apparatus forms an image on a recording medium by using an electrophotographic image forming process. Then, examples of the electrophotographic image forming apparatus include, for example, an electrophotographic copying machine, an electrophotographic printer (for example, such as a color laser beam printer and a color LED printer), a facsimile machine, and a word processor.

In the process cartridge, at least one of a charging means, a developing means, and a cleaning means each serving as process means and an electrophotographic photosensitive member are integrated into a cartridge, which is detachably mountable to an apparatus main body. Note that the charging means, the developing means, and the cleaning means which act on the electrophotographic photosensitive member (hereinafter, referred to as a photosensitive member) are referred to as the process means. Note that, the process cartridge, which integrally includes the photosensitive member and the developing means, is referred to as a so-called integral type. Further, the process cartridge, which integrally includes the photosensitive member and the process means other than the developing means, is referred to as a so-called separation type.

The developing cartridge includes a developing roller, and contains a developer (toner) used to develop an electrostatic latent image (hereinafter, referred to as a latent image) formed on the photosensitive member by the developing roller. Note that, in a case of the developing cartridge, the photosensitive member is provided in the apparatus main body, or in the so-called separation type process cartridge (in this case, the process cartridge has no developing means).

Further, the developing cartridge and the process cartridge are detachably mounted onto an electrophotographic image forming apparatus main body (hereinafter, referred to as an apparatus main body), and contribute to an image forming process for forming an image on a recording medium.

Here, the developing cartridge and the process cartridge can be mounted to and detached from the apparatus main body by the user him/herself. For that reason, the maintenance of the apparatus main body can easily be performed by the user him/herself.

2. Description of the Related Art

In an electrophotographic image forming apparatus, for forming a color image, a method of superimposing developer images (hereinafter, referred to as "toner images") formed with, for example, developers (hereinafter, referred to as "toner") of a yellow color, a magenta color, a cyan color, and a black color is known. Further, a cartage system is widely adopted, in which a developer containing portion (hereinafter, referred to as a toner containing portion) containing toner and a developing member such as a developing roller are incorporated into a frame to obtain a unit (hereinafter, referred to as "developing cartridge"), whereby the toner and the developing roller can be replaced easily when they reach predetermined lives.

On the other hand, another cartridge system is also widely adopted, in which an electrophotographic photosensitive member and process means that acts thereon are integrated to obtain a unit (hereinafter, referred to as a process cartridge), and the photosensitive member and the process means can be replaced easily when they reach predetermined lives.

Further, a method of superimposing toner images includes a 4-pass system and a 1-pass system. According to the 4-pass system, developing devices are disposed side by side with respect to one photosensitive member, and latent images formed on the photosensitive member are successively developed by the respective developing devices to obtain toner images. Then, multiple toner images are superimposed on an intermediate transfer member to form a color image (see Japanese Patent Application Laid-Open No. 2001-117350). According to the 1-pass system, multiple photosensitive members are disposed side by side and latent images on the respective photosensitive members are developed to obtain toner images. Those toner images are successively transferred to a recording medium, whereby a color image is formed (see Japanese Patent Application Laid-Open No. 2006-189737). As one photosensitive member and one exposure unit can constitute the 4-pass system, the 4-pass system is desirable for the reduction in cost and the downsizing of an apparatus. On the other hand, according to the 1-pass system, though multiple photosensitive members and multiple exposure units are required, the printing speed of a color image can be enhanced.

In recent years, a color electrophotographic image forming apparatus (hereinafter, referred to as an image forming apparatus) is becoming widespread, and the needs of users are being diversified. Among them, cases where an image forming apparatus is used on a desktop are increasing, and hence there is a demand for the downsizing of the apparatus.

On the other hand, as illustrated in Japanese Patent Application Laid-Open No. 2001-117350, in an image forming apparatus, it is known that a developing cartridge is inserted in the apparatus main body with a developing roller being a leading edge. Further, as illustrated in Japanese Patent Application Laid-Open No. 2006-189737, in the image forming apparatus, it is known to insert a process cartridge into the apparatus main body with a photosensitive member being a leading edge.

As the apparatus main body is being downsized, the space for mounting a developing cartridge and a process cartridge is also decreasing. Therefore, there is a demand for a technology that enables a developing cartridge and a process cartridge to be replaced easily even in a narrow space. Particularly, in the case of a configuration in which a developing cartridge is inserted in the apparatus main body with a developing roller being a leading edge, the developing roller may come into contact with an adjacent developing cartridge mounted onto the apparatus main body. This contact may damage the developing roller.

SUMMARY OF THE INVENTION

An object of the present invention is to provide a further downsized image forming apparatus.

Another object of the present invention is to provide an image forming apparatus and a developing cartridge which reduce the possibility in that, when the developing cartridge is to be mounted onto a developing cartridge mounting portion, a developing roller of the developing cartridge to be mounted may come into contact with a member on the apparatus main body side. Herein, the member on the apparatus main body side may be an outer wall provided on the apparatus main body and/or an adjacent cartridge that has already been mounted on the cartridge mounting portion and/or the cartridge mounting portion.

Still another object of the present invention is to provide an image forming apparatus and a developing cartridge that can reduce the possibility of the damage of a developing roller at a time of replacement of the developing cartridge.

Still another object of the present invention is to provide an image forming apparatus and a process cartridge that reduce the possibility in that, when the process cartridge is to be mounted onto a process cartridge mounting portion, a photosensitive member of the process cartridge to be mounted may come into contact with a member on the apparatus main body side. Herein, the member on the apparatus main body side may be an outer wall provided on the apparatus main body and/or an adjacent cartridge that has already been mounted on the cartridge mounting portion and/or the cartridge mounting portion.

Still another object of the present invention is to provide an image forming apparatus and a process cartridge that can reduce the possibility of the damage of a photosensitive member at a time of replacement of a process cartridge.

In order to attain the above-mentioned objects, according to the present invention, a developing cartridge detachably mountable to an electrophotographic image forming apparatus main body having a main body side guide portion and a developing cartridge mounting portion on which a plurality of developing cartridges are detachably mounted side-by-side, the developing cartridge comprises: a developer containing portion for containing a developer; a developing roller for developing an electrostatic latent image formed on an electrophotographic photosensitive member using the developer; a first developing cartridge side guide portion provided at each of one end and the other end in a longitudinal direction of the developing roller, for engaging with the main body side guide portion to regulate a movement locus of the developing cartridge when the developing cartridge is mounted to the electrophotographic image forming apparatus main body; and a protruding portion provided at each of the one end and the other end in the longitudinal direction of the developing roller, wherein the developing cartridge is mounted to the electrophotographic image forming apparatus main body in a mounting direction orthogonal to the longitudinal direction of the developing roller, and is mounted to the developing cartridge mounting portion with the developing roller being a leading edge, and the protruding portion protrudes on a downstream side of the developing roller in the mounting direction.

Further, another aspect of the present invention relates to a process cartridge and an electrophotographic image forming apparatus.

Further features of the present invention will become apparent from the following description of exemplary embodiments with reference to the attached drawings.

DESCRIPTION OF THE EMBODIMENTS

Hereinafter, the embodiments according to the present invention will be described with reference to the accompanying drawings. It should be noted that the shapes and relative arrangements of components described in the embodiments do not intend to limit the scope of the present invention, unless otherwise specified.

Embodiment 1

Color Electrophotographic Image Forming Apparatus

Figure 1:
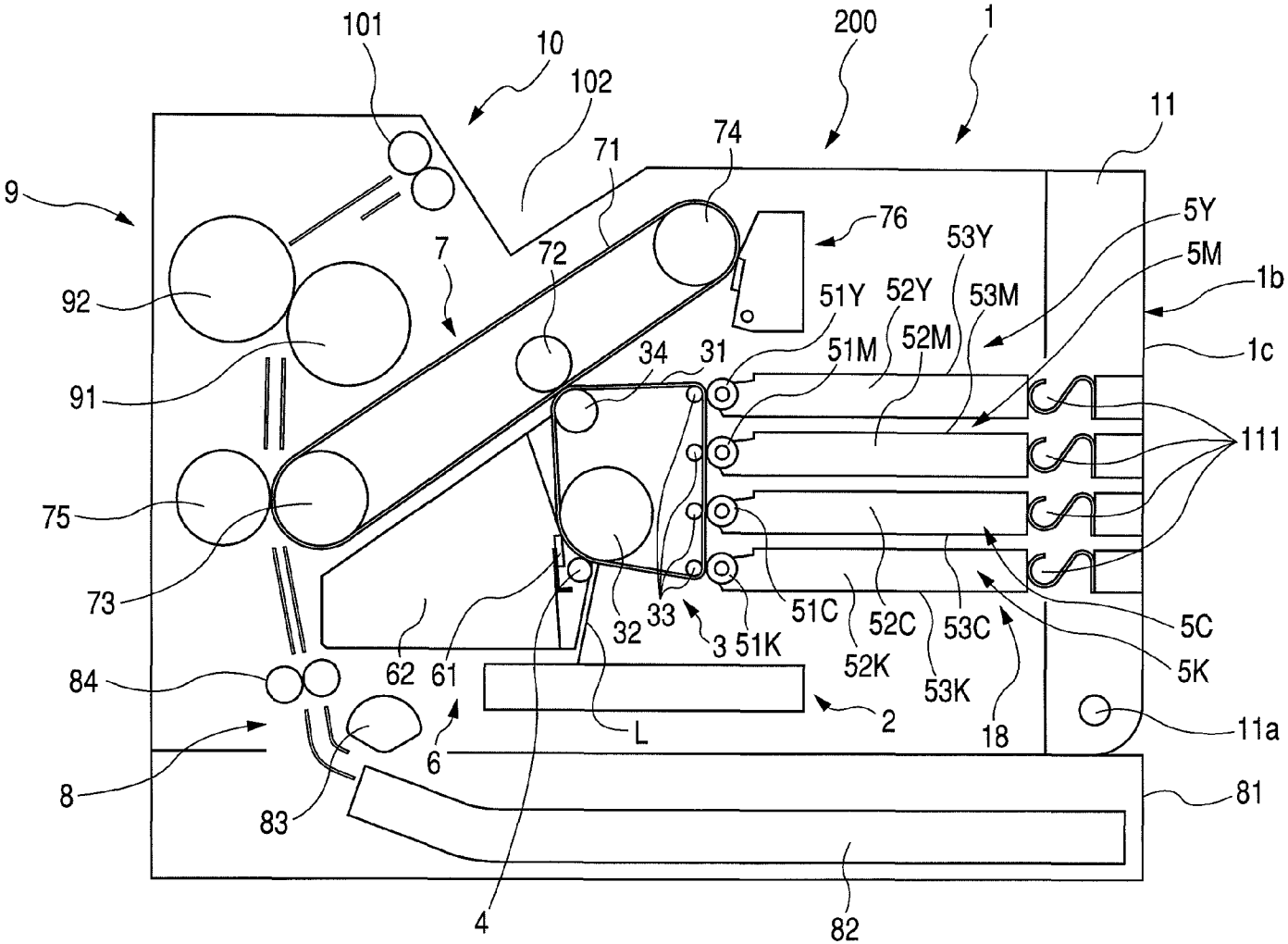
FIG. 1 is an entire structural view of an electrophotographic image forming apparatus of a 4-pass system.

A color electrophotographic image forming apparatus (hereinafter, referred to as an image forming apparatus) 200 of the present invention will be described with reference to FIG. 1. FIG. 1 is a cross-sectional view of an image forming apparatus main body (hereinafter, referred to as an apparatus main body) of a 4-pass system. A photosensitive unit (hereinafter, referred to as a unit) 3 having an electrophotographic photosensitive belt (hereinafter, referred to as a belt) 31 is disposed in a center portion of FIG. 1. Further, a charging roller (charging member) 4 and a scanner 2 that is a latent image forming means are disposed below the unit 3. Further, a cassette 81 in which paper (sheet) 82 as a recording medium is stacked is disposed below the scanner 2. On the right side of the unit 3, developing cartridge mounting portions 18 (FIGS.

1 and 2) on which developing cartridges 5 (5Y, 5M, 5C, 5K) having developing rollers 51 (developing members) (51Y, 51M, 51C, 51K) are detachably mounted are disposed. In FIG. 1, multiple developing cartridges 5 containing developers of different colors are mounted onto the mounting portions 18. The mounting portions 18 are spaces for detachably mounting the cartridges 5. The cartridges 5 mounted onto the mounting portions 18 are pressed toward the unit 3 by the elastic force of pressure springs (elastic members) 111 as pressing members disposed on the right side of the cartridges 5. That is, the developing rollers 51 are urged toward the belt 31. Thus, the cartridges 5 mounted onto the mounting portions 18 are positioned at image forming positions where the developing rollers 51 come into contact with the belt 31. Further, on the left side of the unit 3, a cleaning portion 6 having a cleaning blade (cleaning member) 61 for removing substances adhering to the belt 31 is disposed. On the left side of the cleaning portion 6, a transport portion 8 for transporting the paper (recording medium) 82 is disposed. On the other hand, a transfer portion having a transfer belt (an intermediate transfer member) 71 onto which a developer image (hereinafter, referred to as a toner image) formed on the belt 31 is transferred is disposed above the unit 3. Further, a fixing portion 9 for fixing the toner image on the paper 82 is disposed above the transfer portion 7. The apparatus main body 1 refers to a configuration of the image forming apparatus 200 with the cartridges 5 removed therefrom. Examples of the recording medium include paper and an OHP sheet, on which an image is formed by the image forming apparatus 200.

Next, the configuration of each portion will be described in detail.

(Sheet Feed Portion)

The sheet feed portion 8 will be described with reference to FIG. 1. The sheet feed portion 8 transports the paper 82 stacked the cassette 81 to the transfer portion 7. A sheet feed roller 83 rotates in accordance with the image forming operation of the apparatus main body 1, and feeds the paper 82 stacked in the cassette 81 one by one. A registration roller performs a non-rotation operation for placing the paper 82 in a stationary standby state and a rotation operation for transporting the paper 82 to the transfer portion 7 in a predetermined sequence, thereby registering a toner image in the course of a transfer step with the paper 82. Immediately after the paper 82 is transported, the registration roller 84 suspends rotation. After the formation of a toner image on the transfer belt 71 is completed, the roller 84 starts rotation at a predetermined timing.

(Photosensitive Unit)

Next, the photosensitive unit 3 will be described with reference to FIG. 1. The unit 3 has a belt 31, a driving roller 32 for driving the belt 31, opposed rollers 33 disposed at positions opposed to the developing rollers 51 (51Y, 51M, 51C, 51K) of the respective colors, and a primary transfer opposed roller 34 disposed at a position opposed to a primary transfer roller 72. The belt 31 has a photosensitive layer made of an organic photoconductor on the surface of the belt 31 and is supported rotatably. The belt 31 rotates in the counterclockwise direction by the driving roller 32 at a time of rotation. At a time of an image forming operation, on the belt 31 subjected to a charging treatment by the charging roller 4, an electrostatic latent image is formed with laser light L irradiated from the scanner 2 in accordance with image information. In this embodiment, though the belt 31 is used, a so-called photosensitive drum may be used as a latent image bearing member. The photosensitive drum has a photosensitive layer on the surface of a cylinder.

(Developing Cartridge)

Next, the developing cartridge 5 will be described with reference to FIG. 1. The cartridge 5 has a developer containing portion (hereinafter, referred to as a toner containing portions) 52 (52Y, 52M, 52C, 52K) for containing a developer (hereinafter, referred to as a toner), a developing roller 51, and a developing frame 53 (53Y, 53M, 53C, 53K) for supporting the developing roller 51 rotatably and integrating the toner containing portion 52 therewith. The developing roller 51 rotates in the clockwise direction to carry toner (allow the toner to adhere thereto) at a time of the image forming operation. The carried (adhering) toner is developed in accordance with an electrostatic latent image of the belt 31 in a portion in which the developing roller 51 and the roller 33 are opposed to each other when a predetermined bias is applied to the developing roller 51. Thus, a toner image is formed on the belt 31. The development is conducted for each color, and in the case of forming a full-color image, in this embodiment, toner images are formed in the order of a yellow color, a magenta color, a cyan color, and a black color. In this embodiment, four cartridges are disposed side-by-side in a vertical direction with respect to the installation surface (not shown) of the apparatus 200. This arrangement of cartridges accords to the arrangement corresponding to the shape of the belt 31. For example, if the belt 31 is set diagonally, the four cartridges 5 may be disposed diagonally in accordance with the setting of the belt 31. Further, in the case of using a photosensitive drum in place of the belt 31, four cartridges are disposed in an arc shape in accordance with the shape of the photosensitive drum. The cartridge 5Y contains yellow toner in the toner containing portion 52Y, and forms a yellow toner image. The cartridge 5M contains magenta toner in the toner containing portion 52M and forms a magenta toner image. The cartridge 5C contains cyan toner in the toner containing portion 52C and forms a cyan toner image. The cartridge 5K contains black toner in the toner containing portion 52K and forms a black toner image. The respective cartridges 5 have the same configuration except for containing toner of different colors.

(Transfer Portion)

Next, the transfer portion 7 will be described with reference to FIG. 1. The transfer portion 7 has a transfer belt 71, the primary transfer roller 72, a secondary transfer opposed roller 73, a driving roller 74, a secondary transfer roller 75, and a transfer cleaner 76. At a time of the image forming operation, the belt 71 is rotated by the roller 74 in the clockwise direction. The toner on the belt 31 is transferred to the transfer belt 71 (primary transfer step) by a predetermined bias applied to the transfer roller 72 in a primary transfer nip portion where the opposed roller 34 and the transfer roller 72 are opposed to each other. This operation is repeated to superimpose toner images of a yellow color, a magenta color, a cyan color, and a black color successively on the transfer belt 71, whereby a full-color image is formed. The transfer roller 75 is away from the transfer belt 71 while the primary transfer step is repeated. After four toner images are formed on the transfer belt 71, the transfer roller 75 is moved toward the opposed roller 73 at a predetermined timing to come into contact with the transfer belt 71. At this time, the paper 82 transported from the registration roller 84 is sandwiched by a secondary transfer nip portion between the transfer roller 75 and the opposed roller 73, and the toner image on the transfer belt 71 is transferred to the paper 82 (secondary transfer step) by the application of a predetermined bias to the transfer roller 75. Transfer cleaner 76 is away from the transfer belt 71 while the primary transfer step is repeated. The cleaner 76 comes into contact with the transfer belt 71 at a predetermined timing after the trailing edge of the toner image on the transfer belt 71 passes through the cleaner 76 after the start of the secondary transfer step. Then, residual toner that cannot be transferred completely in the secondary transfer step is cleaned with the cleaner 76.

(Cleaning Portion)

The cleaning portion 6 has a cleaning blade (hereinafter, referred to as a blade) and a waste toner container 62. The toner image formed on the belt is transferred to the transfer belt 71 in the primary transfer nip portion between the opposed roller 34 and the transfer roller 72. The residual toner that has not been transferred is cleaned by the blade 61. The collected residual toner is contained in the removed toner container (removed toner containing portion) 62.

(Fixing Portion)

The fixing portion 9 has a heating roller 91 and a pressure roller 92. When the toner image transferred to the paper 82 passes through a nip portion between the rollers 91 and 92, the toner image is fixed at a predetermined temperature and pressure.

(Delivery Portion)

The paper 82 with the toner image fixed thereon is delivered outside of the apparatus main body by delivery rollers 101 of the delivery portion 10, and stacked on a stacking portion 102.

(Life of a Developing Cartridge)

The toner contained in the toner containing portion 52 is consumed by the repetition of the image forming operation. Further, the developing roller 51 is degraded by the repetition of the image forming operation. When the developing roller 51 is degraded, the quality of an image to be output by the image forming operation may be degraded. That is, when the image forming operation is repeated predetermined times, the developing cartridge 5 reaches the end of the service life thereof. If the developing cartridge 5 is used longer than the life thereof, the image quality may be degraded. When the cartridge 5 does not provide the image quality that can satisfy a user any more, the cartridge 5 is replaced by a new cartridge 5, whereby a satisfactory image forming operation can be performed.

(Guide Member)

Figure 3:
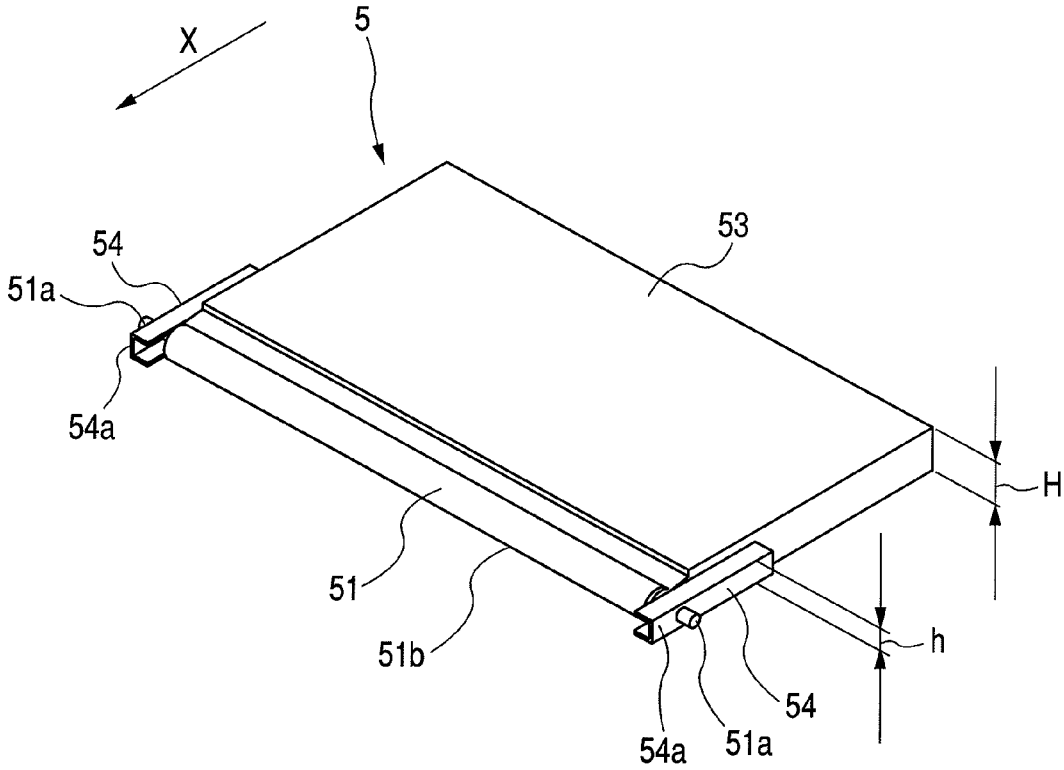
FIG. 3 is a perspective view of the developing cartridge.

FIG. 3 is a perspective view of the cartridge 5. As illustrated in FIG. 3, guide members 54 as developing cartridge side guide portions are provided at one end and the other end in a longitudinal direction of the developing roller 51 supported rotatably by the developing frame 53. In this embodiment, the guide members 54 may be formed directly on the frame 53 or may be separate members. Further, the developing roller 51 is partially exposed from the cartridge 5 (frame 53). The guide members 54 are provided at one end and the other end in the longitudinal direction (longitudinal direction of the developing roller 51) of the cartridge 5, and outside of the frame 53 in a transversal direction (direction orthogonal to the longitudinal direction of the developing roller 51) of the cartridge 5. A shaft 51*a* of the developing roller 51 is supported rotatably by the guide members 54 (frame 53). The guide member 54 has a protruding portion 54*a* extending in a mounting direction X in which the cartridge 5 is mounted onto the apparatus main body 1 (the cartridge mounting portion 18). The protruding portion 54*a* protrudes in the mounting direction X from the developing roller 51. That is, the protruding portion 54*a* protrudes toward the downstream side of a leading edge 51*b* of the developing roller 51 in the mounting direction X. The mounting direction X is orthogonal to the longitudinal direction (axial direction) of the developing roller 51. Further, the leading edge 51*b* is a portion along the longitudinal direction on a most downstream side of the developing roller 51 in the mounting direction X.

(Replacement of a Developing Cartridge)

Figure 2:
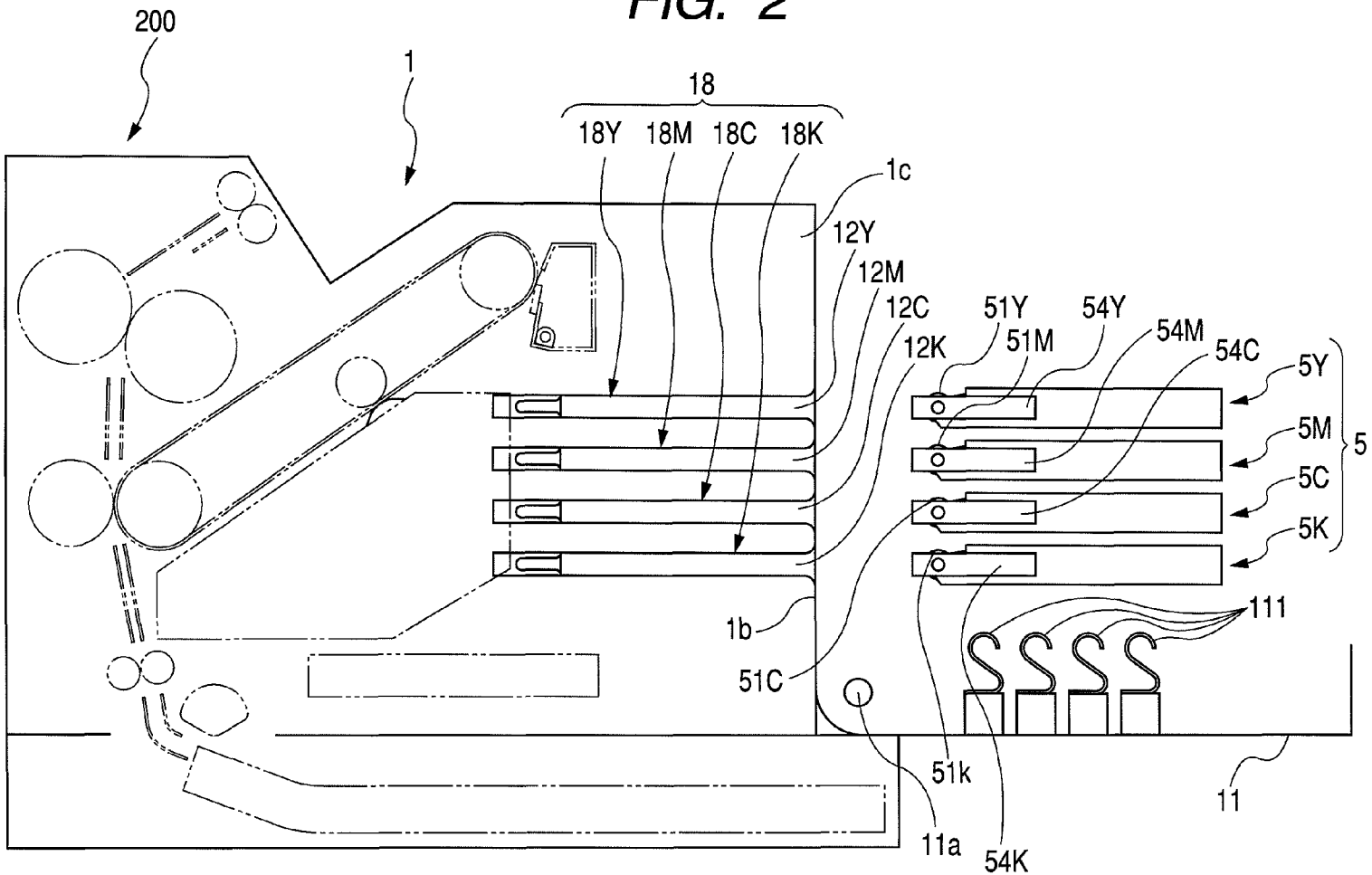
FIG. 2 is a view illustrating a method of replacing a developing cartridge.
Figure 4A:
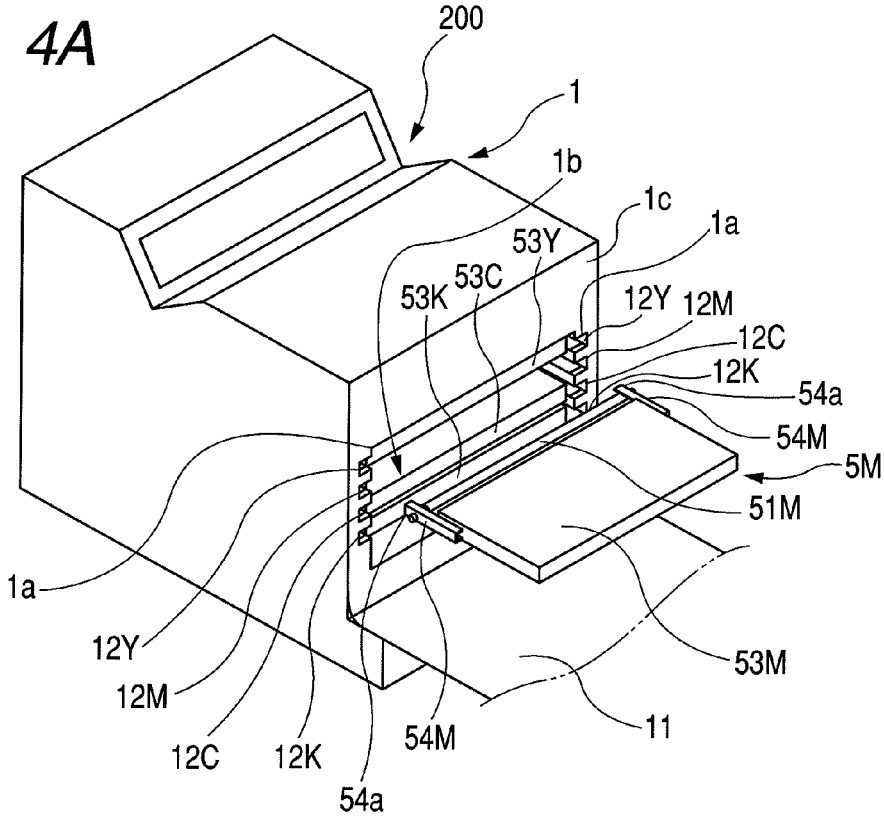
FIG. 4A is a perspective view of a developing cartridge and an apparatus main body.
Figure 4B:
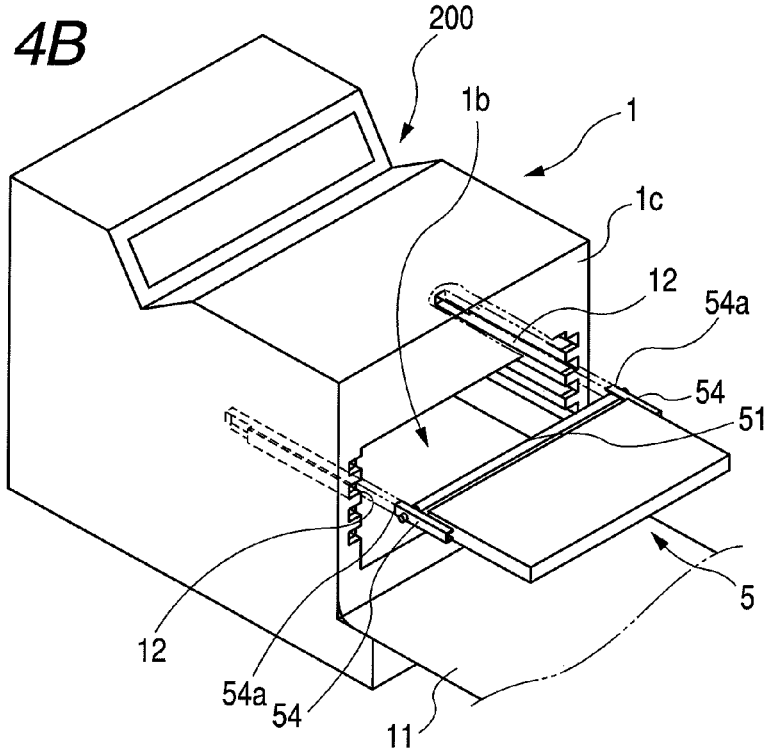
FIG. 4B illustrates a guide groove.

Next, the replacement of the cartridge 5 will be described with reference to FIGS. 2 to 5. As illustrated in FIG. 2, an open/close cover (open/close member) 11 provided at the apparatus main body 1 is opened, and multiple cartridges 5 are detachably mounted onto the cartridge mounting portions 18 (18Y, 18M, 18C, 18K) with the developing rollers 51 being a leading edge. The cover 11 rotates about a hinge 11*a*. The cartridge mounting portion 18 is provided in the apparatus main body 1. The respective cartridges 5 are detachably mountable to the cartridge mounting portions 18 while being lined up side by side in the vertical direction. On the other hand, as illustrated in FIGS. 2 and 4A, the apparatus main body 1 is provided with guide grooves (main body side guide portions) 12 (12Y, 12M, 12C, 12K). Each of the guide grooves 12 regulates a movement locus of the cartridge 5 when a user mounts the cartridge 5 on the apparatus main body 1 (the mounting portion 18). Also, each of the guide grooves 12 regulates a movement locus of the cartridge 5 when a user removes the cartridge 5 from the apparatus main body 1 (the mounting portion 18). Further, each of the guide grooves 12 are provided on inner walls 1*a* of the apparatus main body 1. That is, the guide grooves 12 are provided in the mounting portion 18 so as to be opposed to each other at one end side and the other end side in a direction perpendicular to the mounting direction X. As illustrated in FIG. 4B, the guide grooves 12 are designed so as to be engaged with the guide members 54 when the cartridge 5 is mounted. In this embodiment, as illustrated in FIG. 3, a width h in a height direction of the guide member 54 is set to be smaller than a width H in a height direction of the developing frame 53 (cartridge 5). However, the width h may be set to be the same as the width H in the height direction of the developing frame 53. In this case, the developing frame 53 is allowed to have a function as a guide member.

Note that the movement locus refers to a movement path along which the cartridge 5 reaches the mounting portion 18 (a mounting position for performing an image formation) after the guide members (cartridge side guide portions) 54 are engaged with the guide grooves (main body side guide portions) 12. In this embodiment, the main body side guide portions are the grooves 12. And, the cartridge side guide portions are the guide members 54 that have an elongated shape in the mounting direction in which the cartridges 5 are mounted onto the apparatus main body 1 and that protrude outside from the frames 53. Thus, while the guide members 54 are regulated by the guide grooves 12 in a vertical direction, i.e., while the movement locus thereof is regulated, the cartridge 5 is guided into a predetermined mounting portion 18. However, this embodiment is not limited thereto. For example, the cartridge side guide portion may be a groove or the main body side guide portion may be a protruding portion. Even in this case, the cartridge 5 is guided into the predetermined mounting portion 18 while the cartridge 5 is regulated in a vertical direction, i.e., the movement locus thereof is regulated. Further, for example, the cartridge side guide portion may be a protruding portion, and the main body side guide portion may be a protruding portion. In this case, while the protruding portion as a cartridge side guide portion is supported by the protruding portion as the main body side guide portion, the cartridge 5 is guided into the predetermined mounting portion 18. In such a case, the cartridge 5 is guided into the predetermined mounting portion 18 while the downward movement thereof is regulated, i.e., the movement locus thereof is regulated. This also applied to the embodiments described later. The frames 53 (53Y, 53M, 53C, 53K) are outer walls of the cartridges 5.

Hereinafter, a method of mounting the cartridge 5M will be described by way of example with reference to FIGS. 4A and 5. This also applies to the other cartridges 5, and hence the description thereof is omitted.

As illustrated in FIG. 4A, when the cartridge 5M is to be mounted, the cartridges 5Y and 5C adjacent to the cartridge 5M have already been mounted onto the apparatus main body 1 (the mounting portion 18). Therefore, the cartridge 5M is mounted toward the cartridge 5Y (frame 53Y), the cartridge 5C (frame 53C), and an opening 1*b* provided in an outer wall 1*c* of the apparatus main body 1 (FIG. 4). First, as illustrated in FIG. 4A, guide members 54M and guide grooves 12M are aligned with each other with the developing roller 51M being the leading edge, and the cartridge 5M is moved toward the opening 1*b*. According to this embodiment, in the case where the alignment has not been completed yet, the leading edges of the guide members 54M come into contact with the outer wall 1*c* of the apparatus main body 1 and the adjacent cartridges 5Y and 5C (frames 53Y and 53C) that have already been mounted. Therefore, the cartridge 5M cannot be moved in the mounting direction X any more. Note that the guide members 54M protrude forward in the mounting direction X (on the downstream side in the mounting direction) from the leading edge 51*b* of the developing roller 51M. Therefore, the developing roller 51M does not come into contact with the outer wall 1*c* of the apparatus main body 1 and the cartridges 5Y and 5C. Thus, according to this embodiment, the developing roller 51M can be prevented from being damaged. That is, according to this embodiment, the guide members 54 M are provided so as to have a protrusion length which is capable of preventing the developing roller 51M from coming into contact with the members on the side of the main body 1 when the cartridge 5M is to be mounted onto the apparatus main body 1 while the above-mentioned alignment has not been completed yet. The guide members 54M are provided at positions where they can prevent the developing roller 51M from coming into contact with the members on the side of the main body 1 at one end side and the other end side of the developing roller 51M. Herein, examples of the members on the side of the apparatus main body 1 include the inner wall 1*a* and the outer wall 1*c* provided on the apparatus main body 1 and/or the adjacent cartridges that have already been mounted onto the cartridge mounting portions 18 and/or the cartridge mounting portions 18. The other cartridges 5 also have the same configurations as the cartridge 5M.

Figure 5:
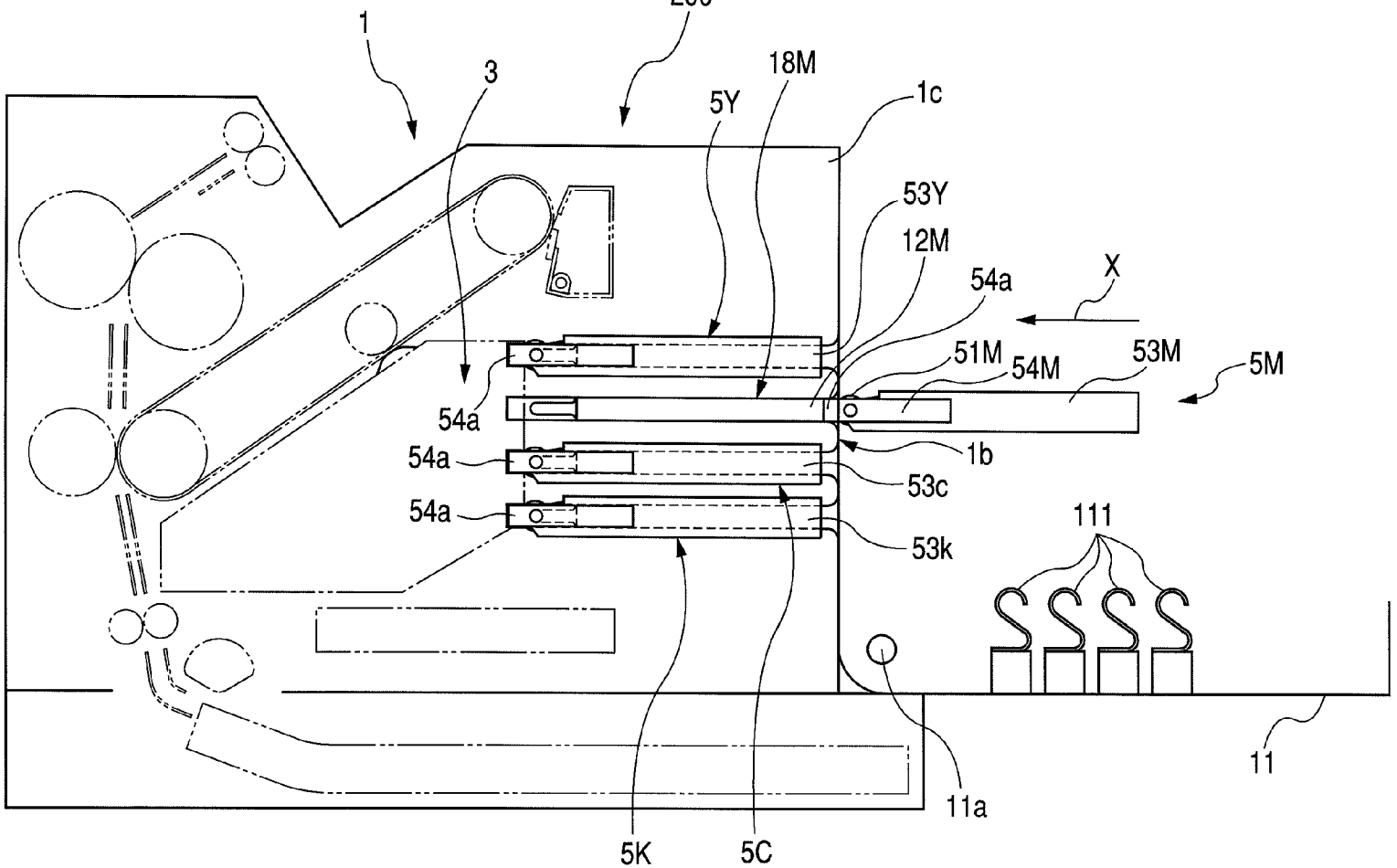
FIG. 5 is a schematic view illustrating a developing cartridge and a guide groove.

As illustrated in FIG. 5, when the cartridge 5M is inserted into the opening 1*b*, first, the guide members 54M and the guide grooves 12M are engaged with each together. The cartridge 5M is further inserted into the apparatus main body 1 as it is. Then, when the developing roller 51M reaches the opening 1*b*, the movement locus at a time of mounting of the cartridge 5M is regulated by the engagement between the guide members 54M and the guide grooves 12M. The cartridge 5M is further moved toward the inner part of the apparatus main body 1. Thus, the cartridge 5M can be mounted onto the mounting portion 18M without bringing the developing roller 51M into contact with the adjacent cartridge 5Y (frame 53Y) and cartridge 5C (frame 53C). Note that when the cartridge 5M is removed from the apparatus main body 1, the operation opposite to the above-mentioned operation may be performed.

While the developing roller 51M passes through the opening 1*b*, the guide members 54M and the guide grooves 12M are engaged with each other. Thus, when the cartridge 5M is removed from the apparatus main body 1, the developing roller 51M does not come into contact with the inner wall 1*a* and the cartridges 5Y, 5C (frames 53Y, 53C). This can also prevent the damage of the developing roller 51M. Further, even in the case where toner adheres to the surface of the developing roller 51M, the cartridges 5Y, 5C (frames 53Y, 53C) can be prevented from being contaminated with the toner.

As described above, according to this embodiment, even if the opening 1*b* is made smaller so as to realize the downsizing of the image forming apparatus 200, the developing roller 51 is not damaged or the periphery thereof is not contaminated with toner. Thus, the cartridge 5 can be replaced smoothly.

Figure 6A:
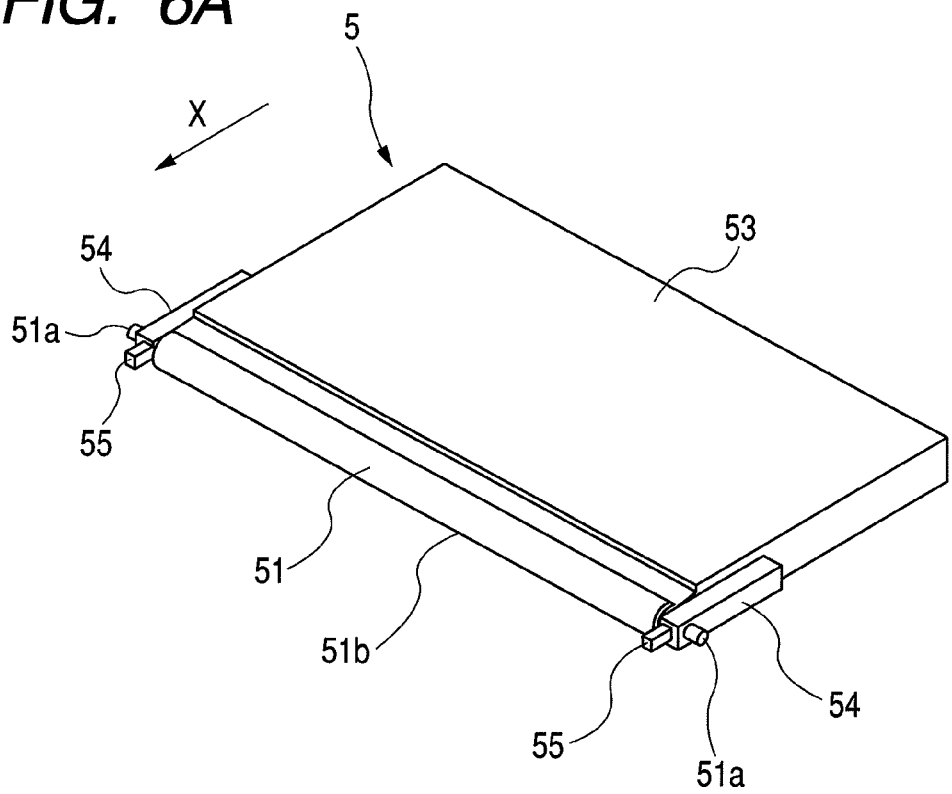
FIG. 6A is a perspective view illustrating a protruding portion of the developing cartridge.

In this embodiment, the guide members 54 have protruding portions 54*a* protruding forward in the mounting direction X (downstream side in the mounting direction X) further than the developing roller 51. However, as illustrated in FIG. 6A, protruding portions 55 may be provided on the cartridge 5 (frame 53). The protruding portions 55 are disposed so as to protrude on the downstream side in the mounting direction X (forward in the mounting direction X) further than the developing roller 51. When the cartridge 5 is to be mounted onto the apparatus main body 1 (mounting portion 18), even if the cartridge 5 is inserted in the apparatus main body 1 while the guide grooves (main body side guide portions) 12 and the guide members (first developing cartridge side guide portions) 54 are not aligned, the protruding portions 55 come into contact with the inner wall 1*a* and the outer wall 1*c* of the apparatus main body, and the adjacent cartridges. Thus, according to this embodiment, the developing roller 51 can be prevented from being damaged, and toner can be prevented from dropping from the developing roller 51. Further, the protruding portions may be provided with a guide function of being engaged with the guide grooves 12 and regulating the movement locus of the cartridge 5.

Figure 6B:
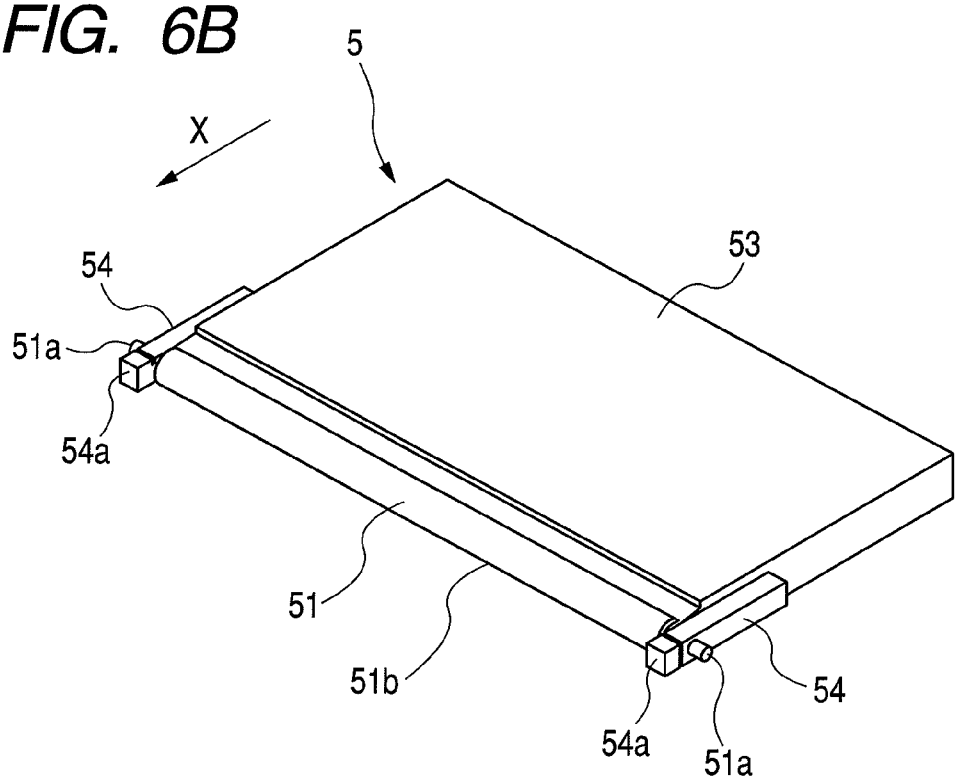
FIG. 6B is a perspective view illustrating a second guide portion of the developing cartridge.

Further, as illustrated in FIG. 6B, the guide members 54 may be provided with second guide portions 54*a* as protruding portions that protrude further on the downstream side (forward) in the mounting direction X, further than the leading edge 51*b* of the developing roller 51. For example, in the frame 53, protruding portions (second developing cartridge side guide portions) 54*a* may be provided at one end side and the other end side in the longitudinal direction of the developing roller 51. In the embodiment illustrated in FIG. 3, the protruding portions 54*a* and the guide members 54 are integrated. However, as illustrated in FIG. 6B, the protruding portions 54*a* may be provided separately from the guide members 54. In the case of those embodiments, the protruding portions 54*a* have a function as the second guide portions for being engaged with the guide grooves (main body side guide portions) 12 to guide the cartridge 5.

Note that, the protrusion length of the protruding portion 54*a* protruding further than the leading edge 51*b* to the downstream side (forward) in the mounting direction X, and the width h of the protruding portion 54*a* may be determined appropriately considering, for example, the curvature of the developing roller 51.

Embodiment 2

Next, Embodiment 2 will be described. In this embodiment, guide members (developing cartridge side guide portions) 56 of the cartridge 5 are movable. The configuration of the apparatus main body is the same as that in Embodiment 1, and hence the description thereof is omitted.

(Developing Frame)

Figure 8:
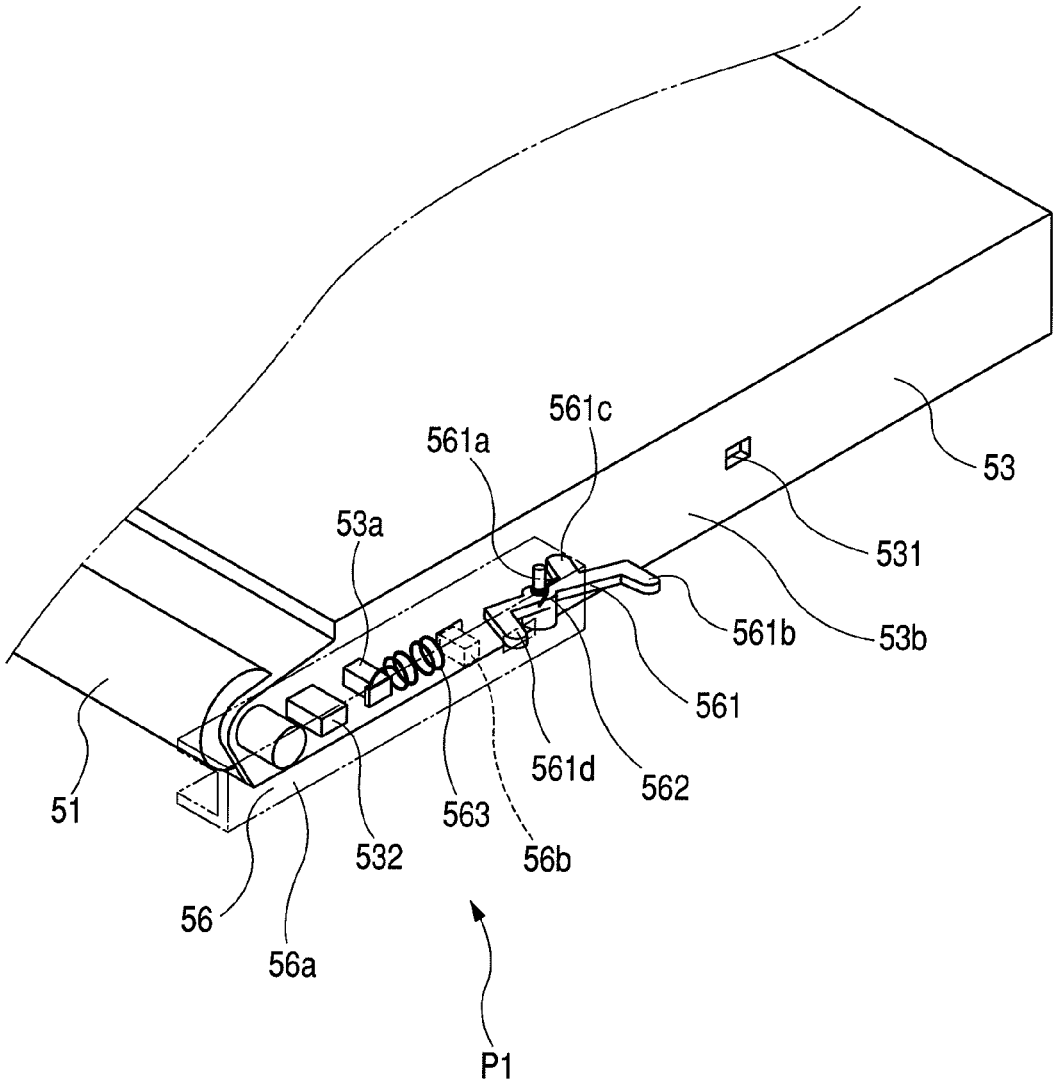
FIG. 8 is a partially enlarged view of the developing cartridge.

As illustrated in FIG. 8, the frame 53 is provided with a developing bias electric contact (hereinafter, referred to as a developing electrode) 532 for receiving a developing bias to be applied to the developing roller 51 from the apparatus main body 1. The frame 53 has (supports) the developing roller 51 and the toner containing portion 52 in an integrated manner. The guide members (developing cartridge side guide portions) 56 are engaged with the guide grooves (main body side guide portions) 12 to regulate the movement locus of the cartridge 5 when the cartridge 5 is mounted and detached from the apparatus main body 1. The frame 53 has a lock hole 531 that is a part of a locking member for locking the guide member 56 at a retracted position P2. The lock hole 531 is provided on the upstream side of the guide member 56 in the mounting direction X.

(Guide Member)

Figure 7A:
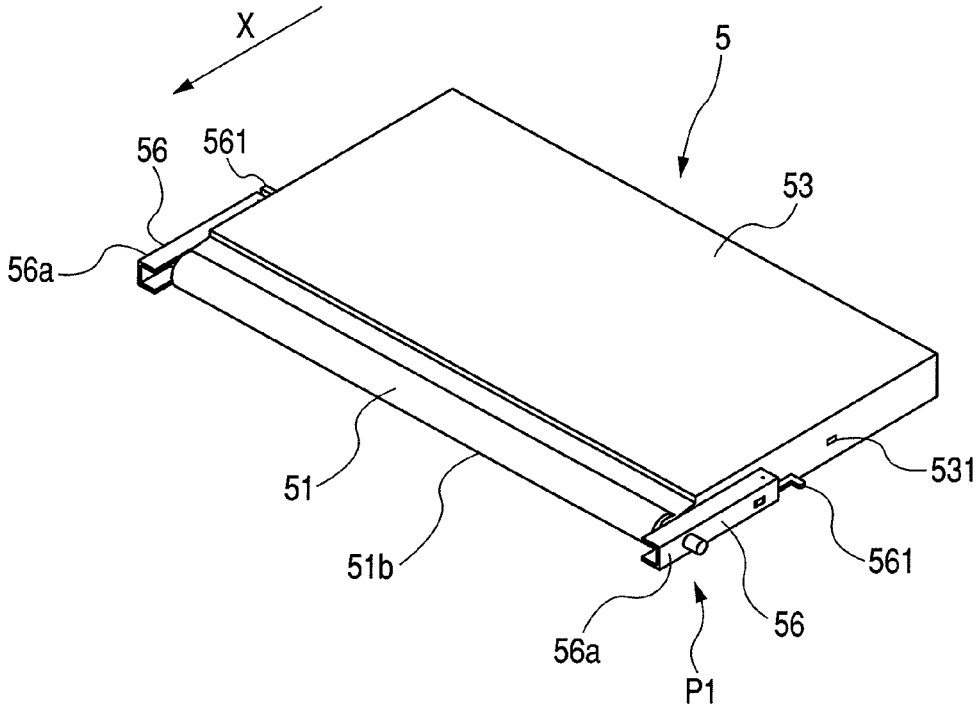
FIG. 7A is a perspective view illustrating a state in which a guide member is at a protruding position.
Figure 7B:
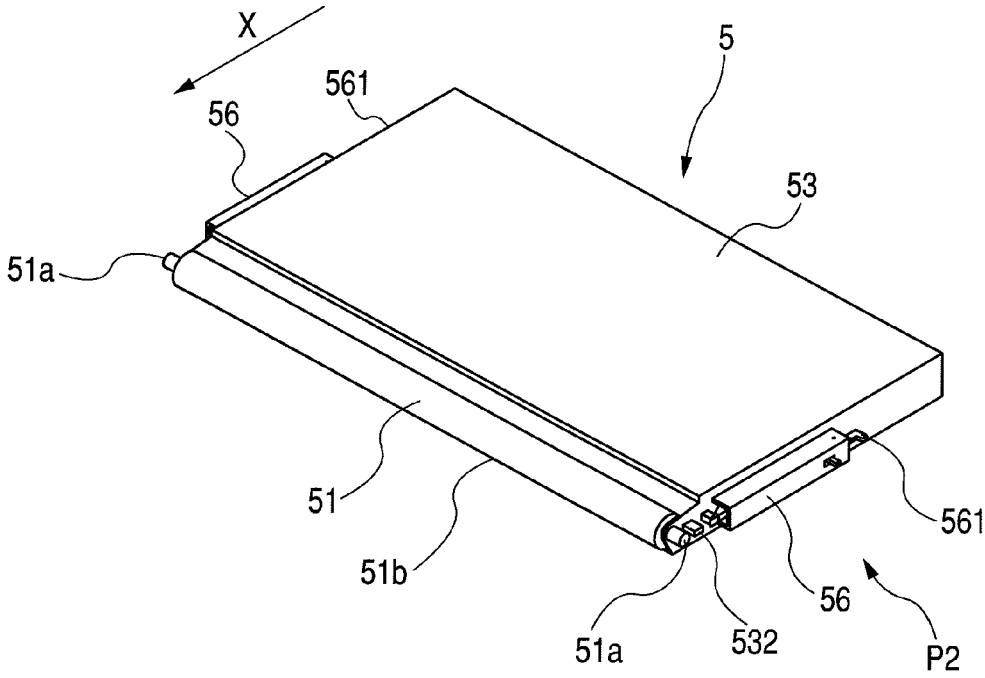
FIG. 7B is a perspective view illustrating a state in which the guide member is at a retracted position.

As illustrated in FIGS. 7A and 7B, the guide members 56 are movable in the mounting direction X. Herein, the mounting direction X refers to a transversal direction of the cartridge 5, which intersects with (is orthogonal to) the longitudinal direction of the developing roller 51. FIG. 7A illustrates the state (hereinafter, referred to as a protruding position P1) in which the guide members 56 protrude on the downstream side in the mounting direction X further than the leading edge 51*b* of the developing roller 51, and FIG. 7B illustrates the state (hereinafter, referred to as a retracted position P2) in which the leading edges of the guide members 56 are retracted on the upstream side in the mounting direction X further than the leading edge 51*b* of the developing roller 51. As illustrated in FIG. 8, the guide member 56 is provided with a guide cam 561, a cam spring (elastic member) 562, and a guide spring (elastic member) 563 that is an urging member of the guide member 56. Further, as illustrated in FIG. 8, when the guide member 56 is disposed at the protruding position P1, the developing electrode 532 is covered with a cover portion 56*a* of the guide member 56. This protects the electrode 532. The cover portion 56*a* serves as a protruding portion. When the cartridge 5 is outside of the apparatus main body 1, the guide member 56 is placed at the protruding position P1. When the guide member 56 is placed at the protruding position P1, the protruding portion 56*a* as the cover portion protrudes on the downstream side in the mounting direction X further than the leading edge 51*b* of the developing roller 51. The guide cam 561 is supported pivotally about a rotation center 561*a*, and is urged in the counterclockwise direction by the elastic force of the spring 562. One end portion of the spring 563 is connected to one end spring attachment portion 53*a* of the developing frame 53, and the other end portion of the spring 563 is connected to the other end spring attachment portion 56*b* of the guide member 56. The guide member 56 is urged elastically from the retracted position P2 to the protruding position P1 by the elastic force of the spring 563. The cam 561 has a first abutting portion 561*b*, a second abutting portion (locking portion) 561*c*, and a third abutting portion (lock releasing portion) 561*d*. As illustrated in FIG. 8, when the guide member 56 is placed at the protruding position P1, the second abutting portion 561*c* comes into contact with a wall surface 53*b* of the developing frame 53. Therefore, even if the elastic force (urging force) of the spring 562 is exerted, the cam 561 cannot pivotally move in the counterclockwise direction any more. However, when the guide member 56 moves to the retracted position P2 as illustrated in FIG. 7B, the second abutting portion 561*c* is pulled in the lock hole 531. Then, by the elastic force of the spring 562, the cam 561 can pivotally move in the counterclockwise direction. When the second abutting portion 561*c* is engaged with the lock hole 531, the guide member 56 is locked at the retracted position P2. When the cam 561 is pivotally rotated in the clockwise direction from this state to release the engagement between the second abutting portion 561*c* and the lock hole 531, the lock of the guide member 56 is released. Then, by the elastic force of the spring 563, the guide member 56 moves from the retracted position P2 to the protruding position P1. That is, the guide member 56 is movable from the protruding position P1 to the retracted position P2, and is urged to the protruding position P1 by the elastic force of the spring 563. Further, the guide member 56 can be locked at the retracted position P2 and unlocked by the cam 561, the spring 562, and the lock hole 531. Further, when the guide member 56 is positioned at the protruding position P1 as illustrated in FIG. 7A, the electrode 532 is protected by the cover portion 56*a* of the guide member 56. The developing electrode 532 is configured to be exposed from the cover portion 56*a* when the guide member 56 is positioned at the retracted position P2 as illustrated in FIG. 7B.

(Guide Groove)

Figure 9:
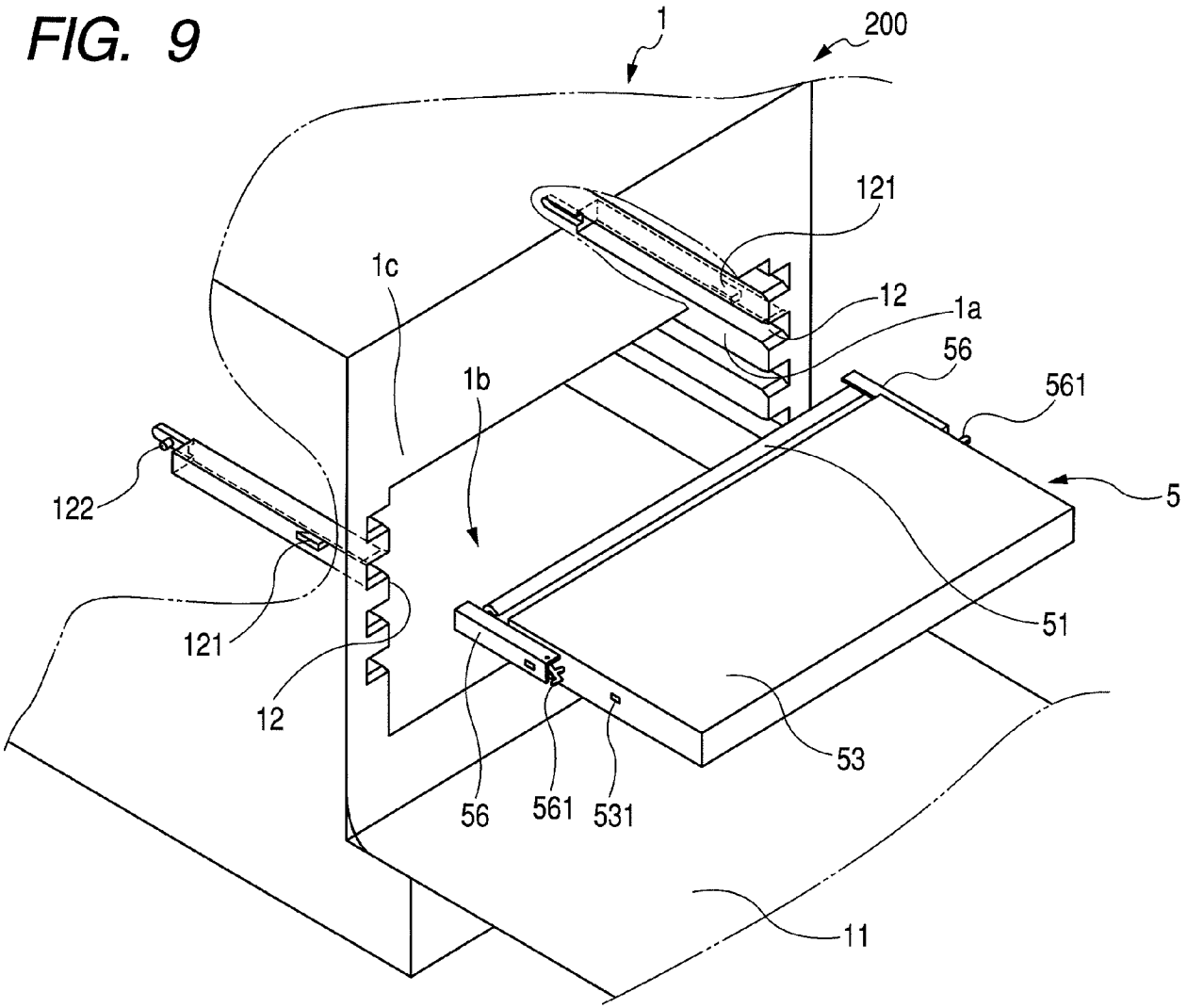
FIG. 9 is a view illustrating a guide groove and a protruding portion.

Further, as illustrated in FIG. 9, each of the guide grooves 12 has a protruding portion 121 as an engagement portion to be engaged with the guide cam 561. Further, each of the guide grooves 12 has an electric contact (body side electric contact) 122 on the apparatus main body side for applying a predetermined bias to the developing roller 51.

(Operation of a Guide Member at a Time of Mounting)

Figure 10A:
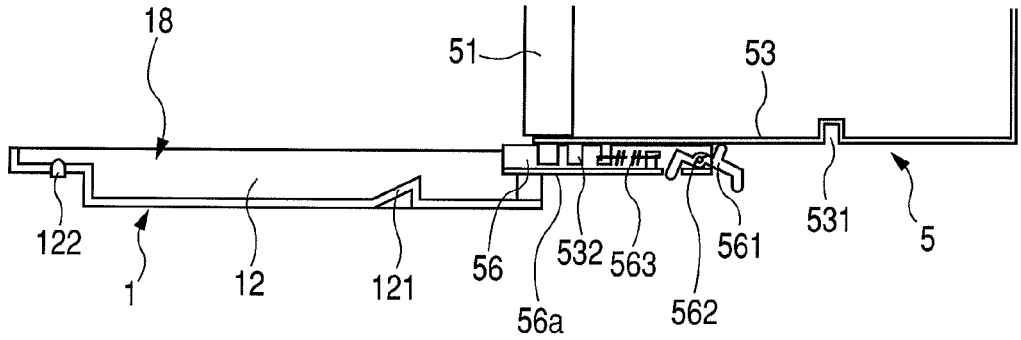
FIGS. 10A, 10B, 10C, and 10D are schematic views illustrating an operation of a guide member and a cam when the developing cartridge is mounted.
Figure 10B:
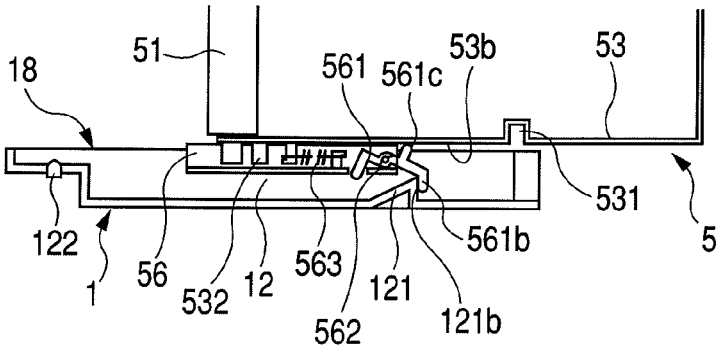
Figure 10C:
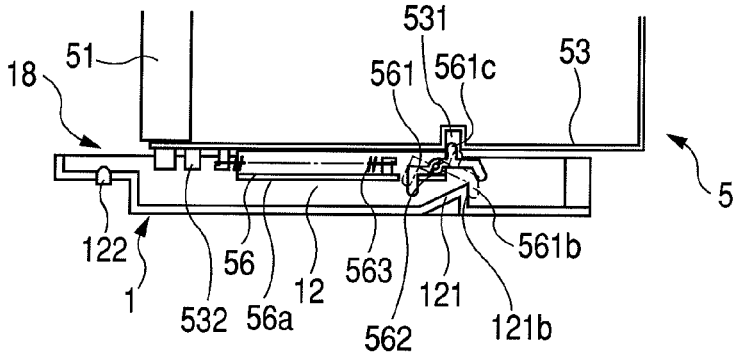
Figure 10D:
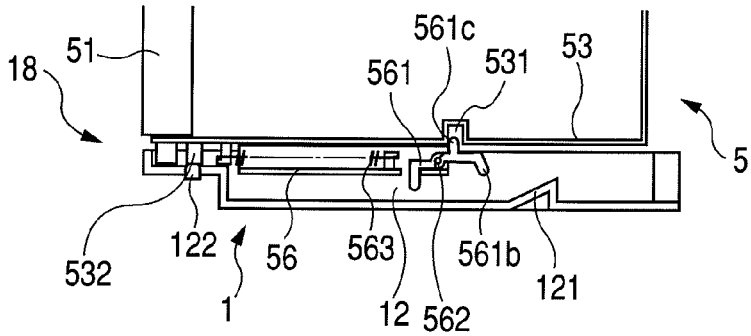

Next, the operations of the guide member 56 and the guide cam 561 when the cartridge 5 is mounted onto the apparatus main body 1 (mounting portion 18) are described with reference to FIGS. 10A to 10D. Note that FIG. 10A illustrates the state in which the cartridge 5 begins to be mounted onto the mounting portion 18 (apparatus main body 1). The mounting operation proceeds as illustrated in FIGS. 10B and 10C, and FIG. 10D illustrates a state in which the mounting operation is completed.

First, as illustrated in FIG. 10A, when the cartridge 5 is mounted onto the apparatus main body 1, the guide members 56 and the guide grooves 12 of the apparatus main body 1 are aligned, and then, the cartridge 5 is inserted into the apparatus main body 1. At this time, because the electrode 532 is covered with the cover portion 56*a* of the guide member 56, the electrode 532 results in being protected. The cartridge 5 is further inserted into the mounting portion 18 to go into the state illustrated in FIG. 10B, in which the first abutting portion 561*b* (abutted portion) of the cam 561 and an abutting portion 121*b* of the protruding portion 121 provided in the guide groove 12 come into contact with each other. At this time, as the cam 561 is pivotally supported, a moment is generated in the counterclockwise direction. However, the second abutting portion 561*c* of the cam 561 comes into contact with the wall surface 53*b* of the developing frame 53. Therefore, the cam 561 cannot be rotated. Thus, when the cartridge 5 is inserted into the mounting portion 18 as it is, the other portions of the cartridge 5 enter the mounting portion 18 while the guide member 56 remains stationary in this state. When the state illustrated in FIG. 10C is obtained, the second abutting portion 561C is pulled in the lock hole 531 provided in the developing frame 53. Then, the cam 561 is rotated in the counterclockwise direction, and the state represented by a chain double-dashed line illustrated in FIG. 10C becomes the state represented by a solid line. At this time, the first abutting portion 561*b* is released from the abutting portion 121*b* of the protruding portion 121 of the guide groove 12. However, the guide member 56 remains locked at this position by the cam 561. At this time, the guide member 56 completes the movement at the retracted position, and the electrode 532 is exposed from the cover portion 56*a* of the guide member 56. If the cartridge 5 is mounted onto the mounting portion 18 as it is, as illustrated in FIG. 10D, the electrode (cartridge side electric contact) 532 and the electric contact (body side electric contact) 122 comes into contact with each other. Then, as illustrated in FIG. 1, the mounting operation of the cartridge 5 is completed when the cover 11 is closed. At this time, the cartridge 5 is pressed in a direction of the belt 31 by the elastic force of the pressure spring (elastic member) 111. However, as described in this embodiment, the guide member 56 remains locked at the retracted position. Therefore, the urging force urging the guide member 56 in a direction of the protruding position by the elastic force of the spring 563 is not applied to the developing roller 51. Thus, by the elastic force of the spring 111, the developing roller 51 can be pressed against the belt 31 at an appropriate pressure.

(Operation of a Guide Portion at a Time of Removal)

Figure 11A:
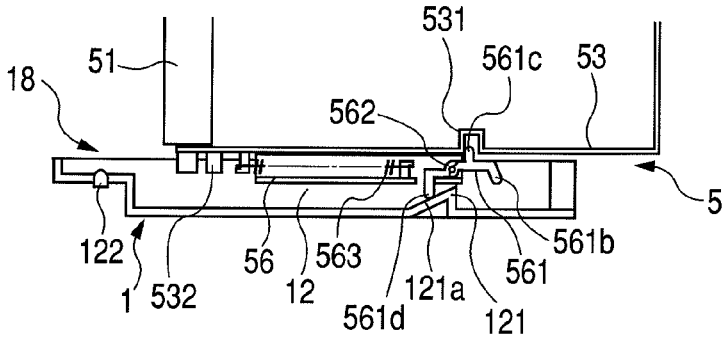
FIGS. 11A, 11B, 11C, and 11D are schematic views illustrating an operation of the guide member and the cam when the developing cartridge is removed.
Figure 11B:
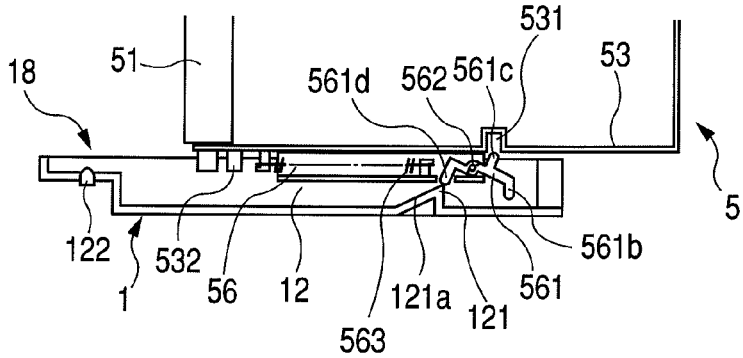
Figure 11C:
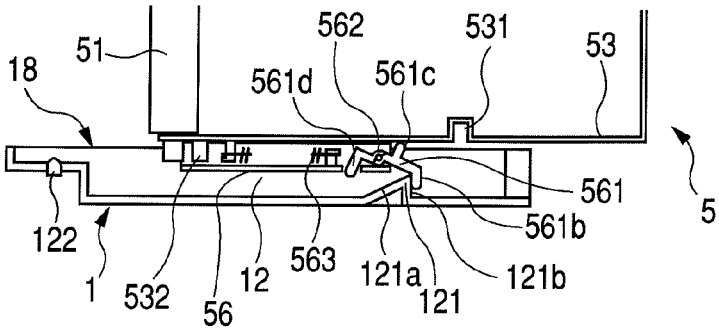
Figure 11D:
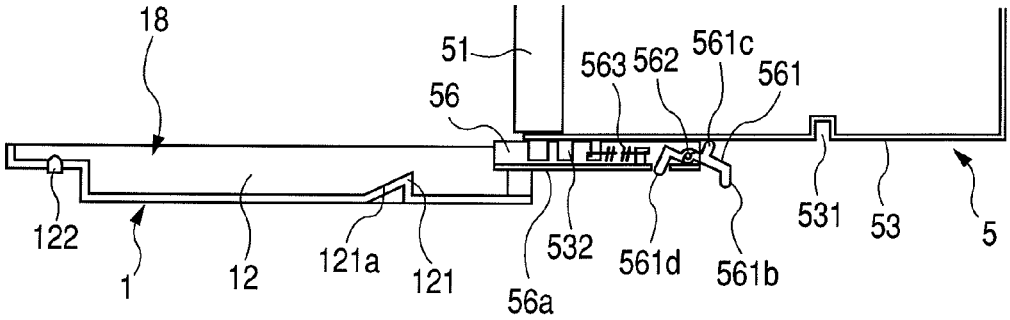

Next, the operations of the guide member 56 and the cam 561 when the cartridge 5 is removed from the main body 1 (mounting portion 18) will be described with reference to FIGS. 11A to 11D. The cartridge 5 is removed from the main body 1 in the order of FIGS. 11A, 11B, 11C, and 11D. First as illustrated in FIG. 2, the cover 11 is opened, and the cartridge 5 is pulled out from the main body 1. At this time, as illustrated in FIG. 11A, the guide member 56 is pulled out while being locked at the retracted position. Then, as illustrated in FIG. 11A, the third abutting portion (lock releasing portion) 561*d* of the cam 561 comes into contact with an inclined surface (engagement portion) 121*a* of the protruding portion 121. When the cartridge 5 is further pulled out of the main body 1 (mounting portion 18), as illustrated in FIG. 11B, the third abutting portion (lock releasing portion) 561*d* runs upon the inclined surface (engagement portion) 121*a*. The cam 561 rotates in the clockwise direction, and the second abutting portion 561*c* is pulled out from the lock hole 531. That is, at this moment, the guide member 56 is released from the state of being locked at the retracted position. That is, the third abutting portion (lock releasing portion) 561*d* is engaged with the inclined surface (engagement portion) 121*a* provided on the guide groove (main body side guide portion) 12 when the cartridge 5 is removed from the mounting portion 18, whereby the lock of the second abutting portion (locking portion) 561*c* is released. Thus, the guide member 56 moves toward the protruding position by the elastic force of the spring 563. Then, as illustrated in FIG. 11C, the guide member 56 moves to a position where the first abutting portion 561*c* of the cam 561 comes into contact with the abutting portion 121*b* of the protruding portion 121. Further, as illustrated in FIG. 11D, when the cartridge 5 is pulled out, the guide member 56 is moved to the protruding position by the elastic force of the spring 563. The cover portion 56*a* of the guide member 56 covers the electrode 532. The movement locus of the cartridge 5 is regulated by the engagement between the guide member 56 and the guide groove 12. Thus, the cartridge 5 can be removed from the main body 1 without bringing the developing roller 51 into contact with the adjacent cartridge 5 and the like.

In Embodiment 1 described above, the guide member 54 is of a fixed type. Therefore, when the cartridge 5 is mounted onto the main body 1, as illustrated in FIG. 5, the leading edge of the guide member 54, i.e., the protruding portion 54*a* enters the side surface of the unit 3. On the other hand, as in this embodiment, when the mounting of the cartridge 5 on the main body 1 is completed, the guide member 56 is retracted to the retracted position P2 as illustrated in FIG. 7B. In this portion, for example, a driving portion for driving the unit 3, an electrode for applying a bias, and the like can be disposed. Thus, the entire apparatus can further be downsized.

That is, according to this embodiment, the guide member 56 has a protrusion length that is capable of preventing the developing roller 51 from coming into contact with the members on the main body 1 side in the case where the cartridge 5 is mounted onto the apparatus main body 1 under the condition that the above-mentioned alignment has not been performed. The guide members 56 are provided at one end side and the other end side of the developing roller 51 so as to prevent the developing roller 51 from coming into contact with the members on the main body 1 side. Herein, examples of the members on the apparatus main body 1 side include the inner wall 1*a* and the outer wall 1*c* provided on the apparatus main body 1 and/or the adjacent cartridges that have already been mounted onto the cartridge mounting portions 18 and/or the cartridge mounting portions 18.

Embodiment 3

This embodiment relates to a color electrophotographic image forming apparatus of a 1-pass system. The image forming apparatus of the 1-pass system has image forming portions respectively corresponding to a yellow color, a magenta color, a cyan color, and a black color, and forms a color image by superimposing those colors successively. Compared with the image forming apparatus of the 4-pass system described in Embodiments 1 and 2, the image forming apparatus of the 1-pass system has an advantage in that color images can be output at a high speed.

Next, Embodiment 3 will be described. Note that the same reference numerals as those in Embodiments 1 and 2 described above denote elements having the same functions as those therein, and hence the description thereof is omitted here.

(Color Electrophotographic Image Forming Apparatus)

Figure 12:
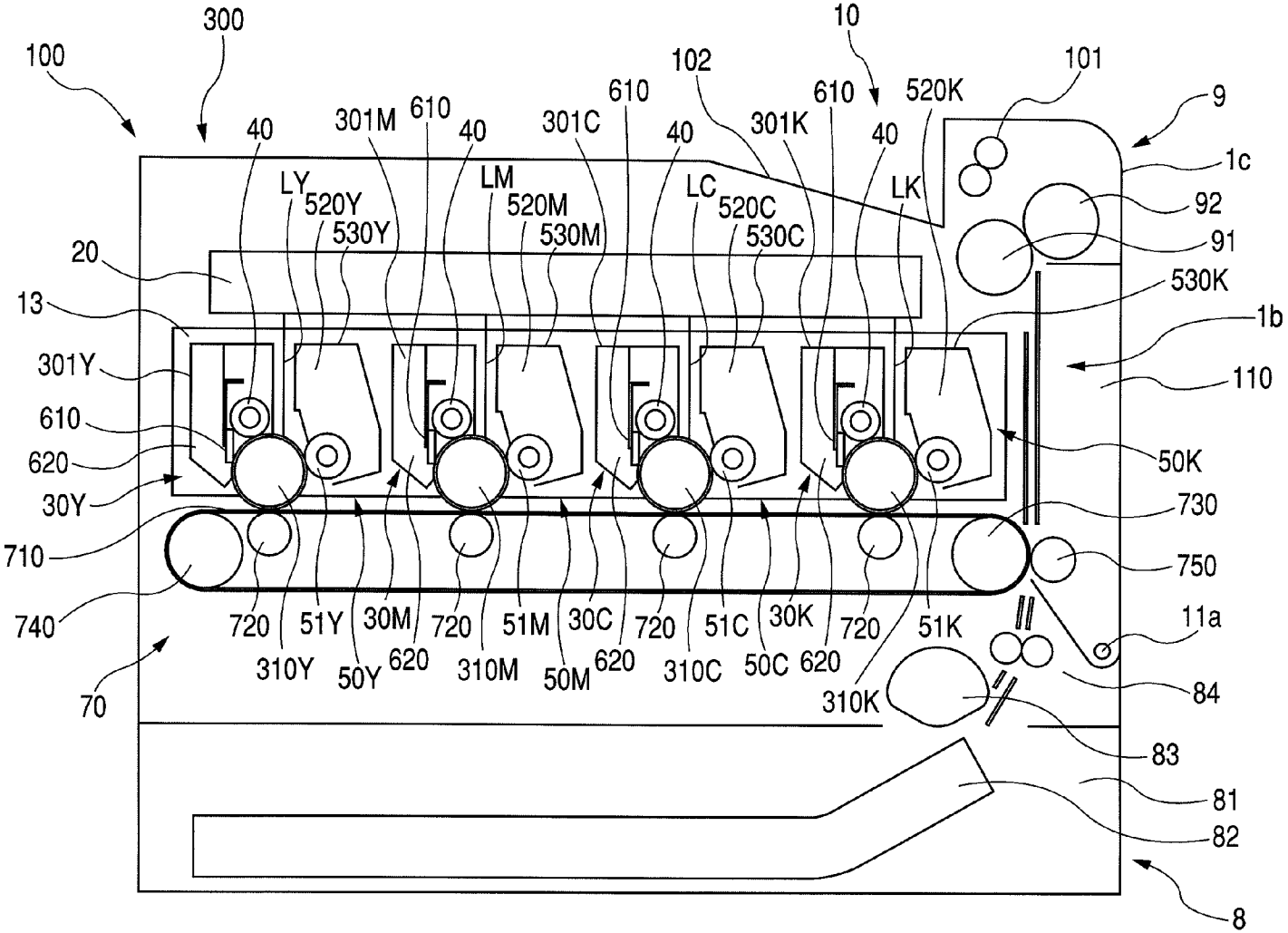
FIG. 12 is an entire structural view of an electrophotographic image forming apparatus of a 1-pass system.

FIG. 12 is a cross-sectional view of a color electrophotographic image forming apparatus main body (hereinafter, referred to as an apparatus main body) 100 of this embodiment. Four electrophotographic photosensitive drums (hereinafter, referred to as drums) 310 (310Y, 310M, 310C, 310K) are arranged side-by-side in a center portion of the apparatus main body 100. Cartridges 50 (50Y, 50M, 50C, 50K) containing toner of a yellow color, a magenta color, a cyan color, and a black color are detachably mounted onto the respective drums 310. The apparatus main body 100 refers to a configuration in which the cartridges 30 and 50 are removed from an image forming apparatus 300. A scanner unit 20 is disposed above the drums 310 and irradiates the respective drums 310 with laser light LY, LM, LC, and LK for forming electrostatic latent images. A transfer portion 70 is disposed below the drums 310, and a cassette 81 containing paper 82 as a recording medium is disposed below the transfer portion 70.

Hereinafter, each portion will be described in detail. This embodiment uses the same sheet feed portion 8, fixing portion 9, and delivery portion 10 as those in Embodiment 1, and hence the description thereof is omitted.

(Process Cartridge)

Each of the process cartridges 30 (30Y, 30M, 30C, 30K) incorporates integrally the electrophotographic photosensitive drum 310 and a charging member 40 and a cleaning member 610, which are process means acting on the drum 310, in a process frame 301 (301Y, 301M, 301C, 301K). Further, the cartridge 30 of this embodiment has a removed toner containing portion 620 containing toner removed from the drum 310 by the cleaning member 610. The drum 310 has a photosensitive layer made of an organic photoconductor on the surface of a cylinder, and is supported rotatably by the process frame 301 and rotated in the clockwise direction during driving.

(Developing Cartridge)

Each of the developing cartridges 50 (50Y, 50M, 50C, 50K) has a toner containing portion 520 containing toner of a yellow color, a magenta color, a cyan color, or a black color, a developing roller 51 as developing means, and a developing frame 530 that rotatably supports the developing roller 51 and integrates the toner containing portion 520. The cartridge 50Y contains yellow toner in the toner containing portion 520Y. The cartridge 50M contains magenta toner in the toner containing portion 520M. The cartridge 50C contains cyan toner in the toner containing portion 520C. The cartridge 50K contains black toner in the toner containing portion 520K.

(Transfer Portion)

The transfer portion 70 has a transfer belt (intermediate transfer member) 710, a primary transfer roller 720, a secondary transfer opposed roller 730, a transfer driving roller 740, and a secondary transfer roller 750.

(Replacement of a Cartridge)

Next, the replacement of the cartridges 30 and 50 will be described. The drum 310, the charging member (process means) 40, and the cleaning member (process means) 610 of the cartridge 30 are degraded as the image forming operation is repeated. Further, the toner containing portion 520 cannot collect toner any more once it has collected a predetermined amount of removed toner. That is, the cartridge 30 reaches the end of the service life thereof when the image forming operation is repeated predetermined times. More specifically, an image of quality that satisfies users cannot be formed any more. When the cartridge 30 reaches the end of the predetermined service life thereof, a satisfactory image forming operation can be performed again by replacing the cartridge 30 by a new one. Likewise, the cartridge 50 also needs to be replaced by a new one when it reaches the end of the service life thereof due to the degradation of the developing roller 51 and the consumption of toner contained in the toner containing portion 520.

(Tray Member)

Figure 13:
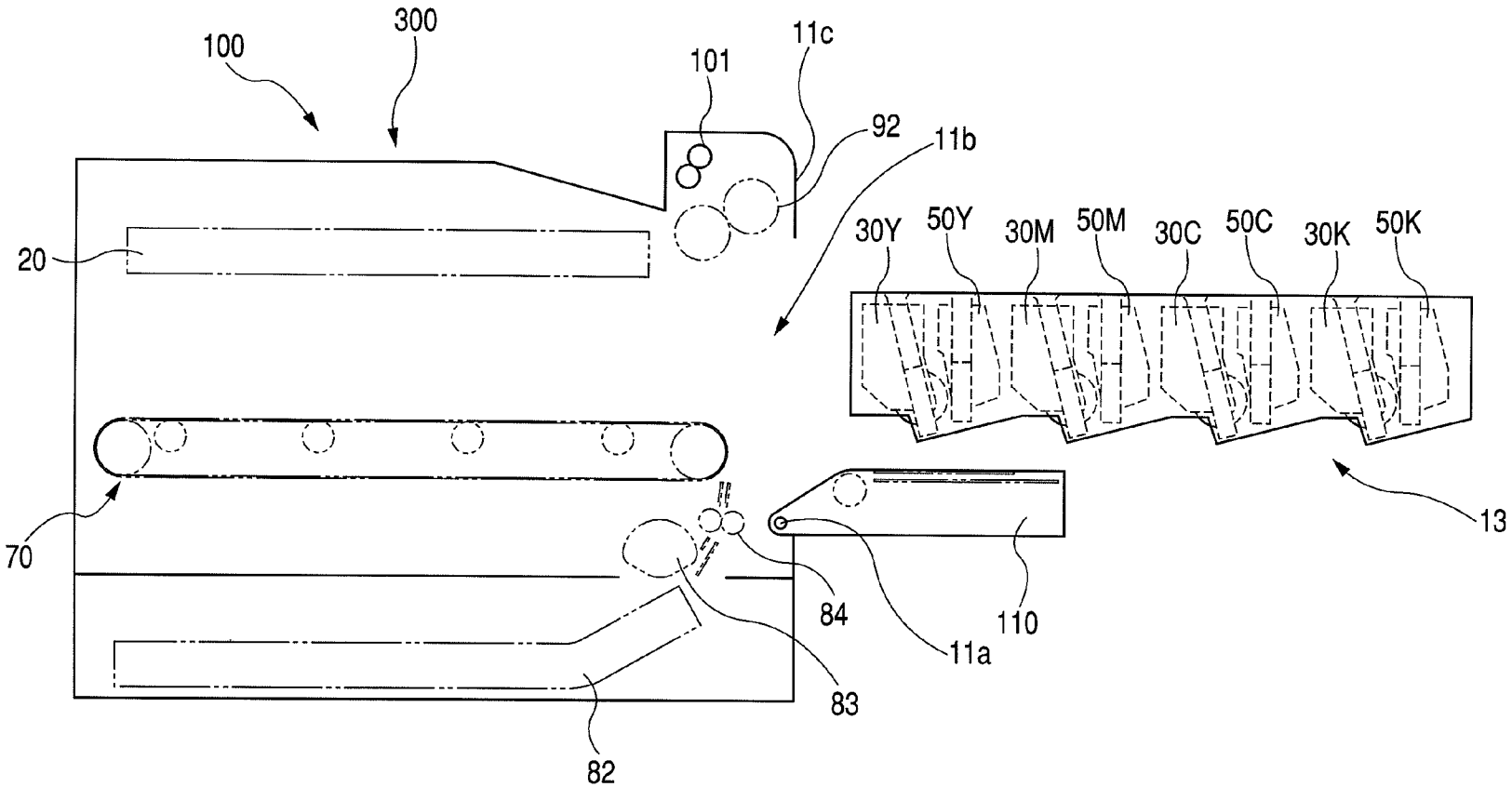
FIG. 13 is a view illustrating a state in which a tray member is removed.
Figure 14:
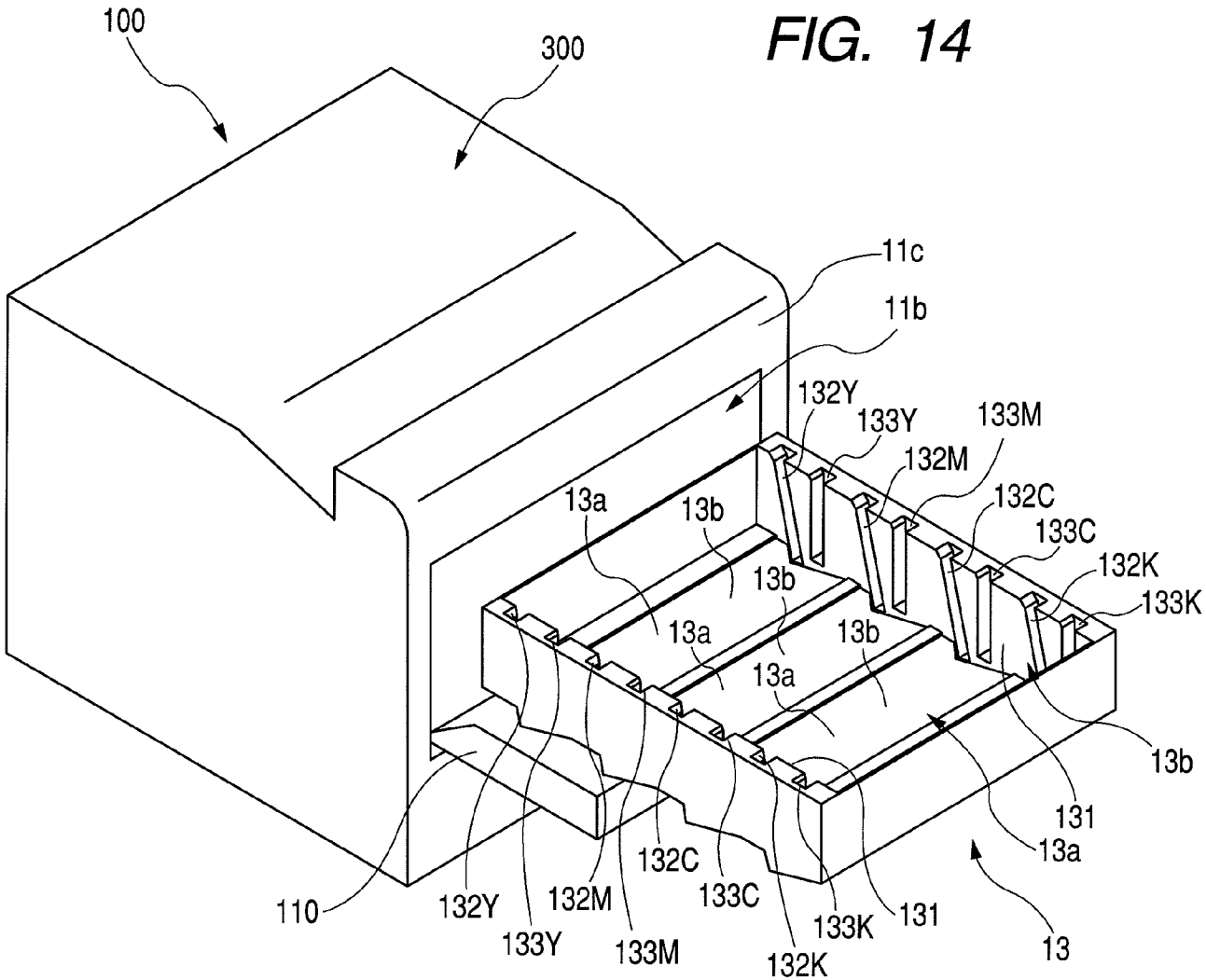
FIG. 14 is a perspective view illustrating a process guide groove and a developing guide groove.

The cartridges 30 and 50 are detachably mounted onto a tray 13 that is a cartridge mounting portion for the cartridges 30, 50. The tray (cartridge mounting portion) 13 corresponds to a process cartridge mounting portion and a developing cartridge mounting portion (cartridge mounting portion). That is, the both the cartridges 30 and 50 are supported by the tray 13. In the tray 13, mounting portions 13*a* on which the cartridges 30 are detachably mounted and mounting portions 13*b* on which the cartridges 50 are detachably mounted are provided alternately in a longitudinal direction of the tray 13. For replacing both the cartridges 30, 50, as illustrated in FIG. 13, the cover 110 is opened, and the tray 13 is taken out from the apparatus main body 100. Then, the cartridges 30, 50 are replaced under the condition that the tray 13 is pulled out from the apparatus main body 100. Note that FIG. 14 illustrates the state in which the tray (cartridge mounting portion) 13 is pulled out from the apparatus main body 100. In this state, the attachment and detachment of the cartridges 30, 50 with respect to the tray (cartridge mounting portion) 13 are performed. The tray 13 may be removed from the apparatus main body 100 when the paper 82 jammed in the apparatus main body 100 is taken out from the apparatus main body 100 (FIG. 14). In this case, a stopper (not shown) restricting the tray 13 from being pulled out from the apparatus main body 100 more than a predetermined amount is released. As described above, the apparatus main body 100 corresponds to a configuration in which the cartridges 30, 50 are removed from the image forming apparatus 300, and the tray 13 is also included in the apparatus body 100.

FIG. 14 illustrates the state in which the tray 13 has been taken out from the apparatus main body 100 and further all the cartridges 30, 50 mounted onto the tray 13 have been taken out. On inner walls of side plates 131 of the tray 13, there is a guide groove (main body side guide portion) 132 that is a main body side (tray side) guide for regulating the movement locus of the cartridge 30 when the cartridge 30 is mounted and detached from the tray 13 and a guide groove (main body side guide portion) 133 that is a main body side (tray side) guide for regulating the movement locus of the cartridge 50 when the cartridge is mounted and detached from the tray 13. The cartridge 30 is guided by the guide groove 132 when being mounted and detached from the tray 13. The cartridge 50 is guided by the guide groove 133 when being mounted and detached from the tray 13.

(Process Cartridge Side Guide Portion)

Figure 15A:
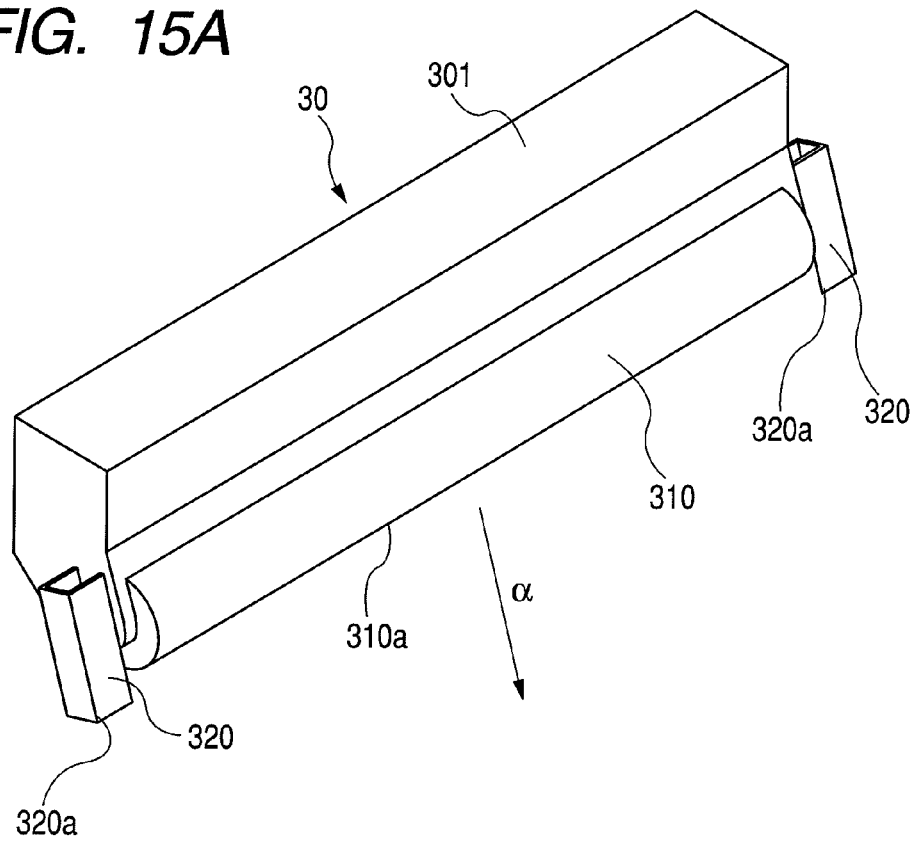
FIG. 15A is a perspective view of a process cartridge.

FIG. 15A is a perspective view of the cartridge 30. The cartridge 30 is mounted in a mounting direction indicated by the arrow a under the condition that the drum 310 is exposed. The mounting direction $\alpha$ is orthogonal to the longitudinal direction of the drum 310. At both ends in the longitudinal direction of the process frame 301, as illustrated in FIG. 15A, there is provided a guide 320, which is a process cartridge side guide portion that is engaged with the guide groove 132 during the mounting and detaching of the cartridge 30 to regulate the movement locus of the cartridge 30. Further, a leading edge in the mounting direction $\alpha$ of the guide 320 (first process cartridge side guide portion) has a protruding portion (second process cartridge side guide portion) 320*a* protruding further than the leading edge 310*a* of the drum 310.

(Developing Cartridge Side Guide Portion)

Figure 15B:
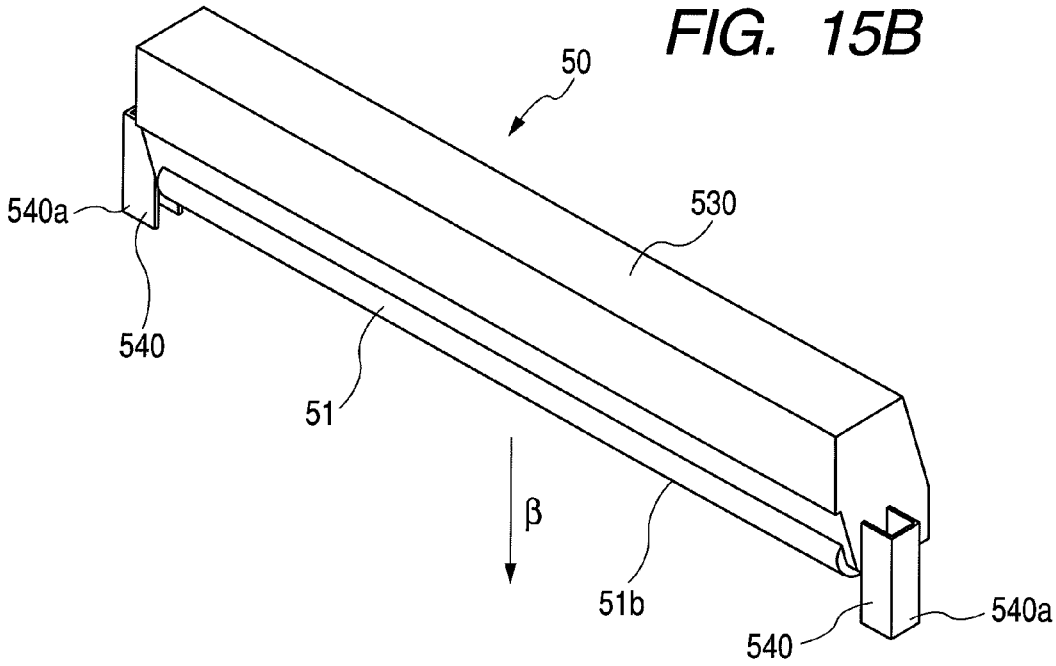
FIG. 15B is a perspective view of a developing cartridge.

FIG. 15B is a perspective view of the cartridge 50. The cartridge 50 is mounted in a mounting direction indicated by the arrow $\beta$ under the condition that the developing roller 51 is exposed. The mounting direction $\beta$ is orthogonal to the longitudinal direction of the developing roller 51. At one end and the other end in the longitudinal direction of the developing frame 530, as illustrated in FIG. 15B, a guide 540 is provided. The guide 540 is a developing cartridge side guide portion that is engaged with the guide groove 133 during the mounting and detaching of the cartridge 50 with respect to the tray 13 to regulate the movement locus of the cartridge 50. Further, a leading edge in the mounting direction $\beta$ of the guide 540 has a protruding portion 540*a* protruding on the downstream side in the mounting direction $\beta$ further than the leading edge 51*b* of the developing roller 51.

(Mounting Operation of a Cartridge with Respect to a Tray)

Next, a method of mounting the cartridges 30, 50 on the tray 13 will be described with reference to FIGS. 16 and 17. In the description, it is assumed that a process cartridge to be replaced is the cartridge 30M paired with the cartridge 50M and a developing cartridge to be replaced is the developing cartridge 50C of cyan. The cartridges 30 and 50 can be respectively replaced independently. Thus, the cartridges 30Y, 30C, 30K and the cartridges 50Y, 50M, 50K that are not required to be replaced have already been mounted onto the tray 13.

Figure 16:
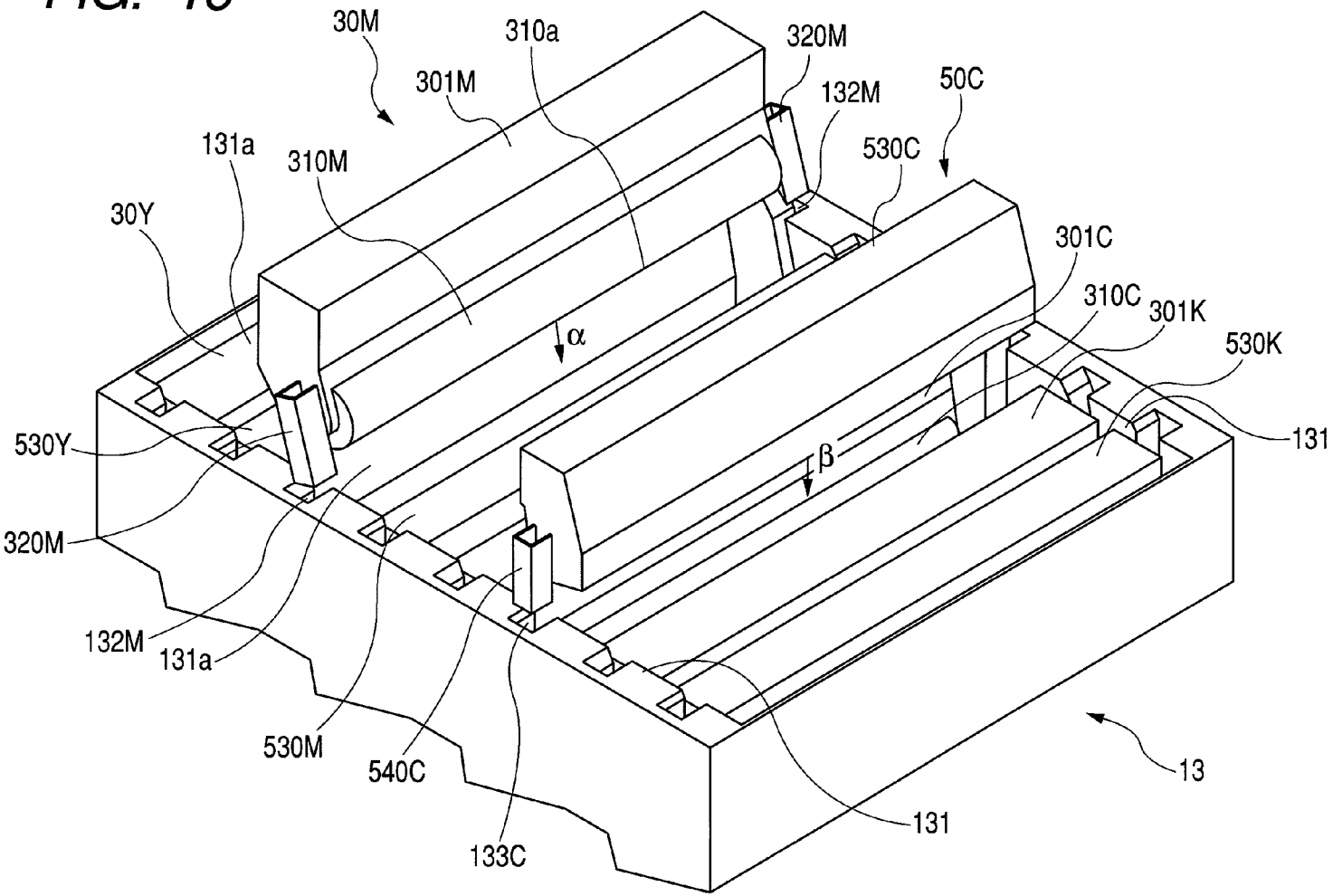
FIG. 16 is a perspective view illustrating a state when the process cartridge and the developing cartridge are mounted.
Figure 17:
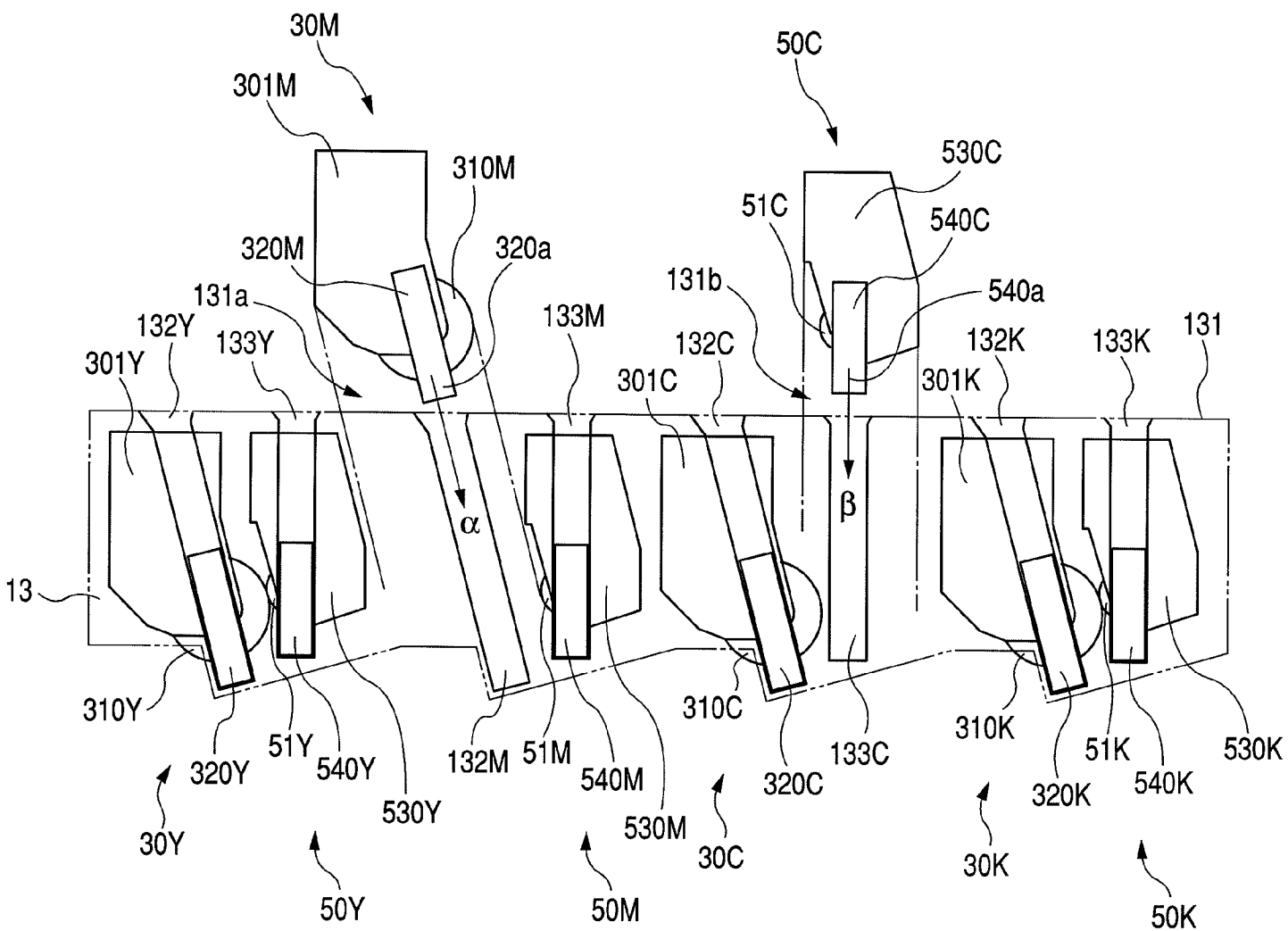
FIG. 17 is a view illustrating a state when the process cartridge and the developing cartridge are mounted.

As illustrated in FIG. 16, guide grooves 132M provided on the side plates 131 of the tray 13 are adapted to receive process cartridge side guides 320M, respectively. Further, guide grooves 133C are adapted to receive developing cartridge side guides 540C. As illustrated in FIG. 17, the cartridge 30M is mounted in the direction indicated by the arrow $\alpha$ from above the tray 13 with the drum 310M directed downward. First, the guides 320M and the guide grooves 132M are aligned, and then, the cartridge 30M is inserted into the tray 13. If the guide 320M is not aligned with the guide groove 132M, the protruding portion 320*a* of the guide 320M comes into contact with the side plate 131. Therefore, the cartridge 30M cannot be inserted any more. At this time, the protruding portion 320*a* of the guide 320M protrudes on the downstream side in the mounting direction α further than the leading edge 310*a* of the drum 310M. Therefore, the drum 310M does not come into contact with the tray 13 to damage the drum 310M. When the guides 320M are aligned with the guide grooves 132M respectively and the cartridge 30M is inserted into the tray 13, the movement locus during the mounting of the cartridge 30M is regulated by the engagement between the guides 320M and the guide grooves 132M. That is, when the drum 310M passes through the adjacent developing frames 530Y, 530M and the opening 131*a* provided on the side plate 131 of the tray 13, the mounting locus of the cartridge 30M has already been regulated. Therefore, the drum 310M can be mounted onto the tray 13 without damaging the drum 310M. The cartridge 50C is mounted in the mounting direction indicated by the arrow β toward an opening 131*b* defined by the process frame 301C, the process frame 301K, and the side plates 131. At this time, in the same way as in the description of the method of mounting a cartridge, when the developing roller 51C passes through the opening 131*b*, the movement locus of the cartridge 50C is regulated by the engagement between the guides 540C and the guide grooves 133C. Thus, the cartridge 50C can be mounted onto the tray 13 without bringing the developing roller 51C into contact with the tray 13 to damage the developing roller 51C. Note that, when the cartridge 30M and the cartridge 50C are taken out of the tray 13, respectively, the operation opposite to the above-mentioned mounting operation should be performed. In this manner, according to this embodiment, a user pushes the tray 13 into the main body 100 under the condition that the cartridges 30, 50 are supported by (mounted onto) the tray 13, whereby the cartridges 30, 50 are mounted at image forming positions of the apparatus main body 100. Further, the user pulls out the tray 13 from the main body 100 under the condition that the cartridges 30, 50 are supported by the tray 13, whereby the cartridges 30, 50 can be taken out from the apparatus main body 100. Note that, regarding the configuration in which the cartridges 30, 50 are positioned at the image forming positions of the apparatus main body 100 by pushing the tray 13 into the inside of the main body 100, a known configuration can be applied appropriately.

Note that, in this embodiment, the main body side guide portions are the guide grooves 132 and 133 provided on the side plate 131 of the tray 13. Further, the cartridge side guide portions are the guide members 320 and 540 that have an elongated shape in the mounting directions α and β in which the cartridges 30 and 50 are mounted onto the tray 13 and that protrude outward from the frames 301 and 530. Thus, the cartridges 30 and 50 are guided to the predetermined mounting portions 13*a* and 13*b* under the condition that the upstream side and the downstream side in the pull-out direction of the tray 13 of the guide members 320 and 540 are regulated by the guide grooves 132 and 133, i.e., under the condition that the movement loci thereof are regulated. However, this embodiment is not limited thereto. For example, the cartridge side guide portion may be a groove, and the main body side guide portion may be a protruding portion. Even in this case, the cartridges 30 and 50 are guided to the predetermined mounting portions 13*a* and 13*b* under the condition that the upstream side and the downstream side in the pull-out direction thereof are regulated, i.e., under the condition that the movement loci thereof are regulated. Further, for example, the cartridge side guide portion may be a protruding portion, and the main body side guide portion may be a protruding portion. In this case, the cartridges 30 and 50 are guided by the predetermined mounting portions 13*a* and 13*b* under the condition that the protruding portion as a cartridge side guide portion is supported by the protruding portion as a main body side guide portion. In such a case, the cartridges 30 and are guided to the predetermined mounting portions 13*a* and 13*b* under the condition that the movement to either the upstream side or the downstream side in the pull-out direction is regulated, i.e., under the condition that the movement loci thereof are regulated.

As described above, according to this embodiment, in the image forming apparatus of the 1-pass system, in the case where the cartridge 30 integrally incorporating the drum and the process means acting on the drum is mounted and detached from the tray (cartridge mounting portion) 13, when the drum moves in the tray 13, the movement locus of the cartridge 30 is regulated. Therefore, the cartridge 30 can be replaced without bringing the drum into contact with the tray 13 to damage the drum.

Figure 18A:
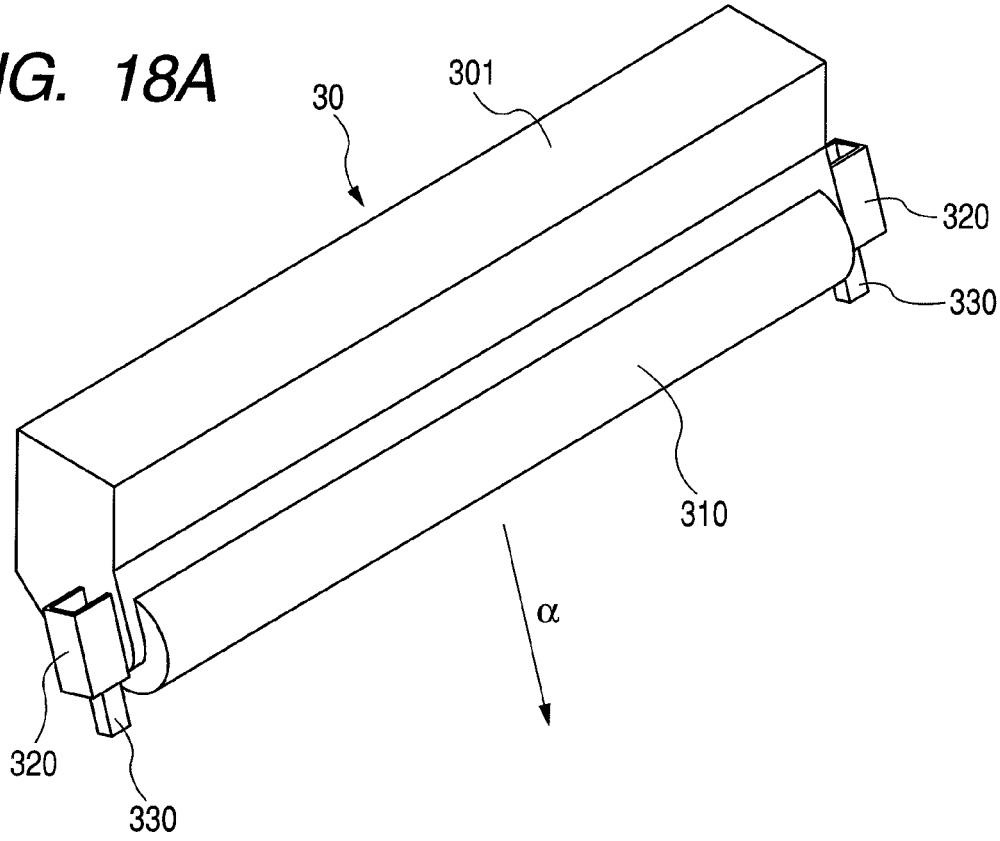
FIG. 18A is a perspective view illustrating a protruding portion of the process cartridge.
Figure 18B:
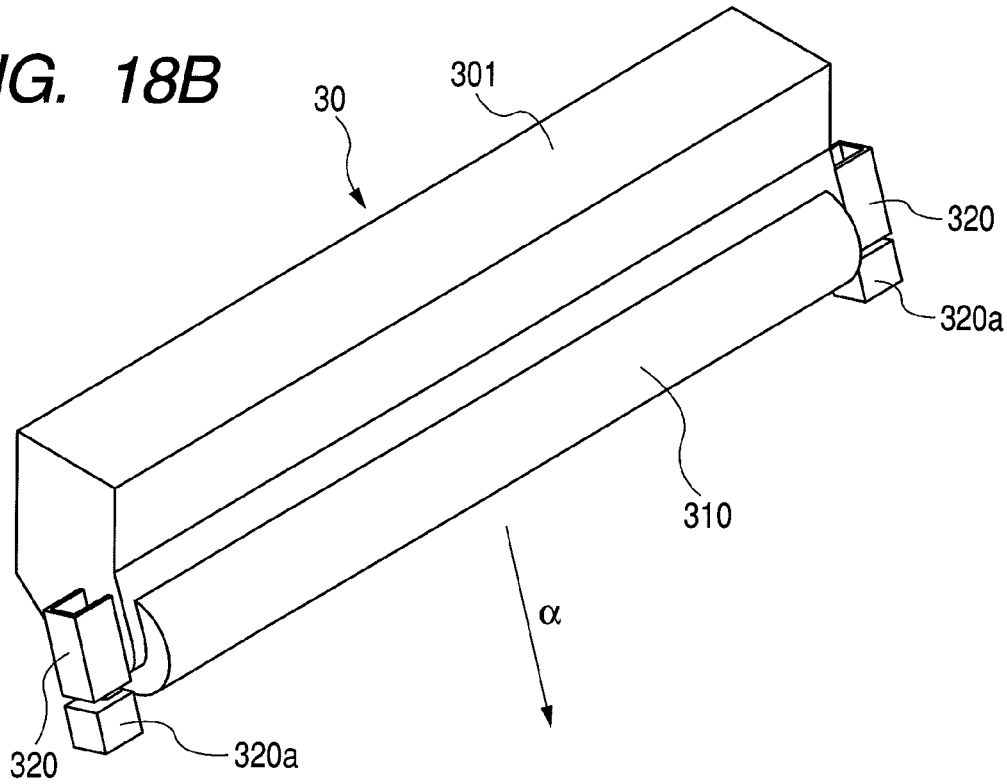
FIG. 18B is a perspective view illustrating a second process cartridge guide of the process cartridge.

In this embodiment, the configuration in which the protruding portion 320*a* of the guide 320 protrudes on the downstream side in the mounting direction α further than the leading edge 310*a* of the drum 310 has been described. However, according to this embodiment, as illustrated in FIG. 18A, the protruding portion 330 may be provided in the process frame 301 of the cartridge 30. That is, as illustrated in FIG. 18A, the protruding portion 320*a* is disposed so that the protruding portion 330 protrudes in the mounting direction α from the drum 310. When the cartridge 30 is mounted onto the apparatus main body, even if an attempt is made to insert the cartridge 30 into the tray 13 (apparatus main body 1) under the condition that the guide groove 132 is not aligned with the process cartridge guide 320 that is a first process cartridge side guide portion, the protruding portion 330 comes into contact with the inner wall of the apparatus main body 100 or the process cartridge or the developing cartridge mounted adjacent thereto, and hence the photosensitive drum can be prevented from being damaged. Further, the protruding portion (second process cartridge side guide portion) 330 may be provided with a guide function of being engaged with the process cartridge guide groove 132 to regulate the movement locus of the process cartridge 30. As illustrated in FIG. 18B, the second process cartridge side guide portion 320*a* as a protruding portion that protrudes in the mounting direction α further than the drum 310 may be provided in the process cartridge guide 320 that is the first process cartridge side guide portion. In the embodiment illustrated in FIG. 15A, the protruding portion 320*a* is integrated with the process cartridge guide 320. However, the protruding portion 320*a* may be provided separately from the process cartridge guide 320, as illustrated in FIG. 18B. The protruding portion 320*a* serves as a second guide portion for guiding the process cartridge. Thus, according to this embodiment, the guide member 320 (320*a*) has a protrusion length capable of preventing the drum 310 from coming into contact with the tray 13 (member on the main body 1 side) in the case where the cartridge 30 is mounted onto the tray 13 under the condition that the above-mentioned alignment has not been performed. In addition, the guide members 320 (320*a*) are provided at one end side and the other end side of the drum 310 where the guide members 320 (320*a*) can prevent the drum 310 from coming into contact with the member on the main body 1 side. Herein, the member on the apparatus main body 1 side may be, for example, the tray (cartridge mounting portion) 13 provided in the apparatus main body 1. Further, the guide 540 (540*a*) has a protrusion length capable of preventing the developing roller 51 from coming into contact with the tray 13 (member on the main body 1 side) when the cartridge 50 is to be mounted onto the tray 13. In addition, the guide members 540 (540*a*) are provided at one end side and the other end side of the developing roller 51 where the guide members 540 (540*a*) can prevent the developing roller 51 from coming into contact with the member on the main body 1 side. Herein, the member on the apparatus main body 1 side may be, for example, the tray (cartridge mounting portion) 13 provided in the apparatus main body 1.

Embodiment 4

Figure 19:
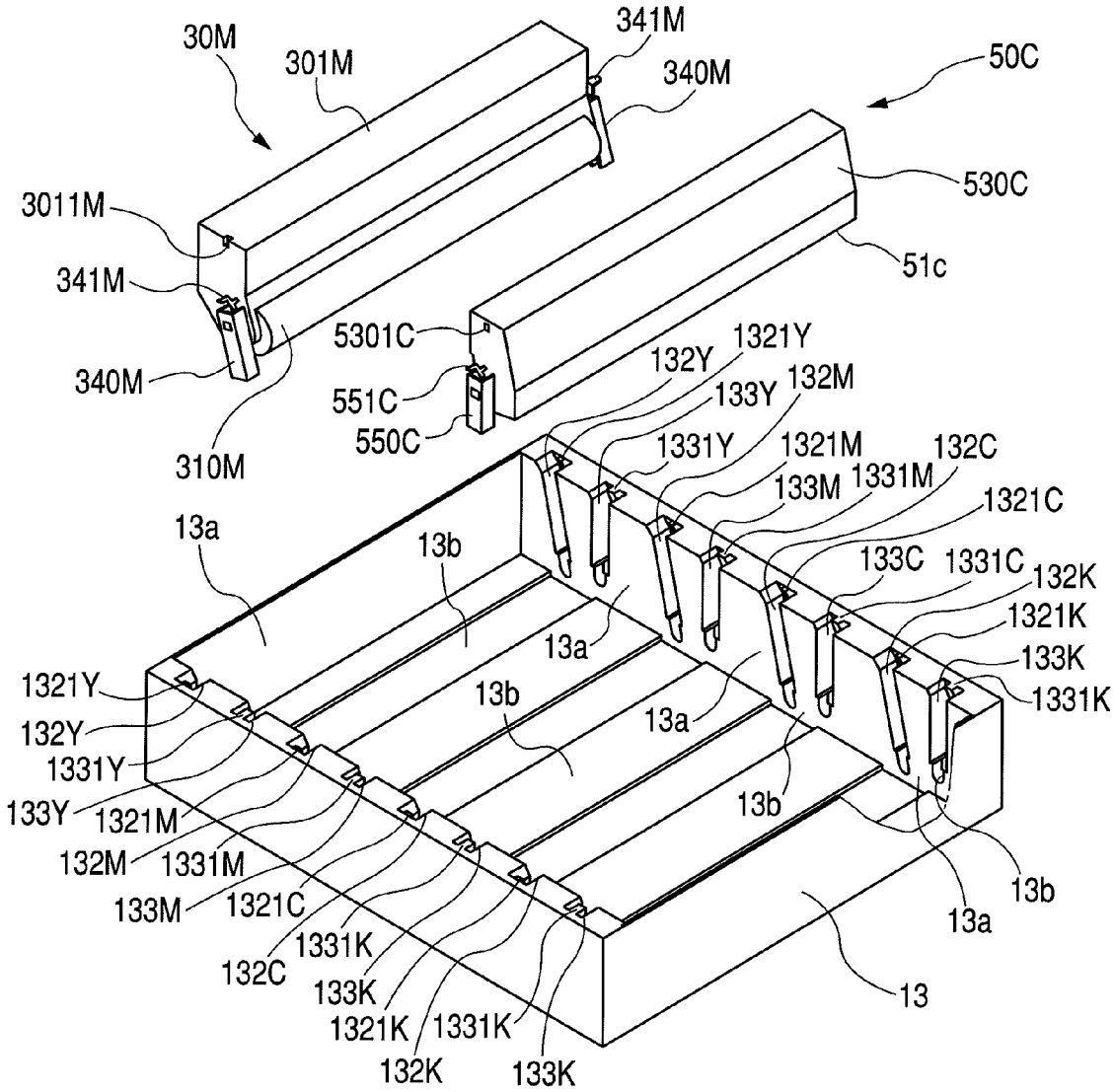
FIG. 19 is a perspective view illustrating a process cartridge, a developing cartridge, and a tray member.

Further, in the configuration illustrated in Embodiment 3, as illustrated in FIG. 19, a guide member may be movable between the protruding position and the retracted position, and further provided with a locking portion as illustrated in Embodiment 2. As illustrated in FIG. 19, the tray (cartridge mounting portion) 13 has process cartridge mounting portions and developing cartridge mounting portions (cartridge mounting portions). Multiple cartridges 30 can be mounted side-by-side in the horizontal direction and detached from the process cartridge mounting portions 13*a* of the tray 13. The cartridge 30 is detachably mounted onto the mounting portion 13*a* with the photosensitive drum 310 being a leading edge. Further, multiple developing cartridges 50 can be mounted side-by-side in the horizontal direction and detached from the developing cartridge mounting portions 13*b* of the tray 13. The cartridge 50 is detachably mounted onto the mounting portion 13*b* with the developing roller 51 being a leading edge. On the tray 13, the mounting portions 13*a* and the mounting portions 13*b* are provided alternately in the longitudinal direction of the tray 13. In the guide grooves (main body side guide portions) 132 (132Y, 132M, 132C, 132K) provided on the inner wall of the tray 13, protruding portions 1321 (1321Y, 1321M, 1321C, 1321K) serving as abutting portions and engagement portions are provided, and in the guide grooves 133 (main body side guide portions) (133Y, 133M, 133C, 133K), protruding portions 1331 (1331Y, 1331M, 1331C, 1331K) serving as abutting portions and engagement portions are provided.

Hereinafter, the cartridge 30M will be described. The other cartridges also have the same configuration as that of the cartridge 30M, and hence the description thereof is omitted. Each of process cartridge side guide portions 340M provided at one end and the other end in the longitudinal direction (longitudinal direction of the drum 310) of the cartridge 30M is provided with a cam 341M. The guide portion 340M protrudes retractably on the downstream side further than the leading edge 310*a* of the drum 310 in the mounting direction in which the cartridge 30M is mounted onto the mounting portion 13*a* of the tray 13. The cam 341M is a locking portion that locks the guide portion 340M when the guide portion 340M moves to the retracted position. The process frame 301 is provided with a lock hole 3011M with which the cam 341M is engaged. Further, in the same way as in Embodiment 2 illustrated in FIG. 8, the cartridge 30 has a guide spring (elastic member) (not shown) urging the guide 340M in a protruding position direction and a cam spring (elastic member) (not shown) urging the cam 341M in the rotation direction.

Hereinafter, the developing cartridge 50C will be described. The other cartridges also have the same configuration as that of the developing cartridge 50C, and hence the description thereof is omitted. Each of developing cartridge side guides 550C provided at one end and the other end in the longitudinal direction (longitudinal direction of the developing roller 51) of the cartridge 50C is provided with a cam 551C. The cam 551C is a locking portion that locks the guide 550C when the guide 550C moves to the retracted position. A developing frame 530C is provided with a lock hole 5301C with which the cam 551C is engaged. In the same way as in Embodiment 2 illustrated in FIG. 8, a guide spring (elastic member) (not shown) urging the developing cartridge side guide 550C toward the protruding position, and a cam spring (elastic member) (not shown) urging the cam 551 to the rotation direction are provided. The description regarding those operations is omitted since they are similar to those in Embodiment 2.

With the configuration of the cartridge 30, the guide portion 340 can be moved to the retracted position when the cartridge 30 is mounted onto the tray 13. Similarly, when the cartridge 50 is mounted onto the tray 13, the guide portion 550 can be moved to the retracted position. Thus, the guide grooves 132, 133 provided on the tray 13 can be shortened compared with the respective guide grooves illustrated in Embodiment 3. This can downsize the tray 13. Further, a pressing member (elastic member) (not shown) pressing the cartridge 30 to the transfer belt 710 may be provided. The pressing member presses the cartridge 30 so that the electrophotographic photosensitive drum 310 is directed to a transfer belt 710 onto which a developer image formed on the electrophotographic photosensitive drum 310 is transferred. Thus, when the cartridge 30 is mounted onto the apparatus main body 100, the pressing force of the drum 310 pressing the transfer belt is kept appropriately. Further, when the cartridge 30 is pressed by the pressing member, the guide portion 340 is locked at the retracted position by the cam (locking portion) 341.

Note that, even in this embodiment, the arrangement, the protrusion length, and the like of the guide member may be determined in the same way as in Embodiment 3 described above.

As described above, according to an embodiment of the present invention, a further downsized image forming apparatus can be provided.

Further, according to the embodiment of the present invention, it is possible to provide an image forming apparatus and a developing cartridge capable of reducing the possibility that, when the developing cartridge is mounted onto a developing cartridge mounting portion, a developing roller of the developing cartridge to be mounted comes into contact with a member on an apparatus main body side.

Further, according to the embodiment of the present invention, it is possible to provide an image forming apparatus and a developing cartridge capable of reducing the damage of a developing roller at a time of replacement of the developing cartridge.

Further, according to another embodiment of the present invention, it is possible to provide an image forming apparatus and a process cartridge capable of reducing the possibility that, when the process cartridge is mounted onto a process cartridge mounting portion, a photosensitive member of the process cartridge to be mounted comes into contact with a member on an apparatus main body side.

Further, according to another embodiment of the present invention, it is possible to provide an image forming apparatus and a process cartridge capable of reducing the damage of a photosensitive member at a time of replacement of the process cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-057447, filed Mar. 11, 2009, which is hereby incorporated by reference herein in its entirety.

What is claimed is:

1. A developing cartridge detachably mountable to an electrophotographic image forming apparatus main body having main body side guide portions and a developing cartridge mounting portion to which a plurality of developing cartridges are detachably mountable side-by-side, the developing cartridge comprising:

a developer containing portion for containing a developer;

a developing roller for developing an electrostatic latent image formed on an electrophotographic photosensitive member using the developer;

first developing cartridge side guide portions provided at one end and the other end, respectively, in a longitudinal direction of the developing roller, for engaging with the main body side guide portions to regulate a movement locus of the developing cartridge when the developing cartridge is mounted to the electrophotographic image forming apparatus main body; and protruding portions provided at the one end and the other end, respectively, in the longitudinal direction of the developing roller, wherein the developing cartridge is mounted to the electrophotographic image forming apparatus main body in a mounting direction orthogonal to the longitudinal direction of the developing roller with the developing roller being a leading edge, wherein the protruding portions are second developing cartridge side guide portions, which protrude on a downstream side further than the developing roller in the mounting direction, and engage with the main body side guide portions to regulate the movement locus of the developing cartridge when the developing cartridge is mounted to the developing cartridge mounting portion, wherein one of the first developing cartridge side guide portions and a corresponding one of the second developing cartridge side guide portions are an integrated developing cartridge side guide portion, wherein the developing cartridge side guide portion is movable between a protruding position at which the developing cartridge side guide portion protrudes on the downstream side further than the developing roller in the mounting direction and a retracted position at which the developing cartridge side guide portion is retracted on an upstream side further than a leading edge of the developing roller in the mounting direction, wherein the developing cartridge side guide portion is positioned at the protruding position when the developing cartridge is taken out from the electrophotographic image forming apparatus main body, wherein, when the developing cartridge is moved toward the developing cartridge mounting portion while the developing cartridge side guide portion is engaged with a main body side guide portion, an abutting portion provided on the main body side guide portion and an abutted portion of the developing cartridge side guide portion come into contact with each other so that the developing cartridge side guide portion is moved from the protruding position to the retracted position, and wherein, when the developing cartridge reaches the developing cartridge mounting portion, the developing cartridge side guide portion is positioned at the retracted position.

2. A developing cartridge according to claim 1, further comprising:

an urging member for urging the developing cartridge side guide portion elastically from the retracted position to the protruding position;

a locking portion for locking the developing cartridge side guide portion at the retracted position when the developing cartridge side guide portion is moved from the protruding position to the retracted position; and a lock releasing portion for releasing a lock of the locking portion by the lock releasing portion being engaged with an engagement portion provided on the main body side guide portion when the developing cartridge is taken out from the developing cartridge mounting portion, wherein the developing cartridge side guide portion is locked at the retracted position when the developing cartridge is pressed by a pressing member provided in the electrophotographic image forming apparatus main body for pressing the developing cartridge so that the developing roller is directed to the electrophotographic photosensitive member.

3. A developing cartridge according to claim 1, further comprising a developing bias electric contact for receiving a bias applied to the developing roller from the electrophotographic image forming apparatus main body, wherein the developing bias electric contact is covered with a cover portion formed in the developing cartridge side guide portion when the developing cartridge side guide portion is positioned at the protruding position, and wherein the developing bias electric contact is exposed from the cover portion of the developing cartridge side guide portion when the developing cartridge side guide portion is positioned at the retracted position.

4. A process cartridge detachably mountable to an electrophotographic image forming apparatus main body having main body side guide portions and a process cartridge mounting portion to which a plurality of process cartridges are detachably mountable side-by-side, the process cartridge comprising:

an electrophotographic photosensitive drum;

first process cartridge side guide portions provided at one end and the other end, respectively, in a longitudinal direction of the electrophotographic photosensitive drum, for engaging with the main body side guide portions to regulate a movement locus of a process cartridge when the process cartridge is mounted to the electrophotographic image forming apparatus main body; and protruding portions provided at the one end and the other end, respectively, in the longitudinal direction of the electrophotographic photosensitive drum, wherein the process cartridge is mounted to the electrophotographic image forming apparatus main body in a mounting direction orthogonal to the longitudinal direction of the electrophotographic photosensitive drum with the electrophotographic photosensitive drum being a leading edge, wherein the protruding portions are second process cartridge side guide portions, which protrude on a downstream side further than the electrophotographic photosensitive drum in the mounting direction, and engage with the main body side guide portions to regulate the movement locus of the process cartridge when the process cartridge is mounted to the process cartridge mounting portion, wherein one of the first process cartridge side guide portions and a corresponding one of the second process cartridge side guide portions are an integrated process cartridge side guide portion, wherein the process cartridge side guide portion is movable between a protruding position at which the process cartridge side guide portion protrudes on the downstream side further than the electrophotographic photosensitive drum in the mounting direction and a retracted position at which the process cartridge side guide portion is retracted on an upstream side further than a leading edge of the electrophotographic photosensitive drum in the mounting direction, wherein the process cartridge side guide portion is positioned at the protruding position when the process cartridge is taken out from the electrophotographic image forming apparatus main body, wherein, when the process cartridge is moved toward the process cartridge mounting portion while the process cartridge side guide portion is engaged with a main body side guide portion, an abutting portion provided on the main body side guide portion and an abutted portion of the process cartridge side guide portion come into contact with each other so that the process cartridge side guide portion is moved from the protruding position to the retracted position, and wherein, when the process cartridge reaches the process cartridge mounting portion, the process cartridge side guide portion is positioned at the retracted position.

5. A process cartridge according to claim 4, further comprising:

an urging member for urging the process cartridge side guide portion elastically from the retracted position to the protruding position;

a locking portion for locking the process cartridge side guide portion at the retracted position when the process cartridge side guide portion is moved from the protruding position to the retracted position; and a lock releasing portion for releasing a lock of the locking portion by the lock releasing portion being engaged with an engagement portion provided on the main body side guide portion when the process cartridge is taken out from the process cartridge mounting portion, wherein the process cartridge side guide portion is locked at the retracted position when the process cartridge is pressed by a pressing member provided in the electrophotographic image forming apparatus main body for pressing the process cartridge so that the electrophotographic photosensitive drum is directed to a transfer member on which a developer image formed on the electrophotographic photosensitive drum is transferred.

6. An electrophotographic image forming apparatus to which a plurality of developing cartridges are detachably mounted for forming an image on a recording medium, the electrophotographic image forming apparatus comprising:

main body side guide portions; and a developing cartridge mounting portion to which the plurality of developing cartridges are detachably mounted side-by-side, each of the plurality of developing cartridges comprising:

a developer containing portion for containing a developer;

a developing roller for developing an electrostatic latent image formed on an electrophotographic photosensitive member using the developer;

first developing cartridge side guide portions provided at one end and the other end, respectively, in a longitudinal direction of the developing roller, for engaging with the main body side guide portions to regulate a movement locus of a developing cartridge when the developing cartridge is mounted to an apparatus main body of the electrophotographic image forming; and protruding portions provided at the one end and the other end, respectively, in the longitudinal direction of the developing roller, wherein the developing cartridge is mounted to the apparatus main body in a mounting direction orthogonal to the longitudinal direction of the developing roller with the developing roller being a leading edge, wherein the protruding portions are second developing cartridge side guide portions, which protrude on a downstream side further than the developing roller in the mounting direction, and engage with the main body side guide portions to regulate the movement locus of the developing cartridge when the developing cartridge is mounted to the developing cartridge mounting portion, wherein one of the first developing cartridge side guide portions and a corresponding one of the second developing cartridge side guide portions are an integrated developing cartridge side guide portion, wherein the developing cartridge side guide portion is movable between a protruding position at which the developing cartridge side guide portion protrudes on the downstream side further than the developing roller in the mounting direction and a retracted position at which the developing cartridge side guide portion is retracted on an upstream side further than a leading edge of the developing roller in the mounting direction, wherein the developing cartridge side guide portion is positioned at the protruding position when the developing cartridge is taken out from the electrophotographic image forming apparatus main body, wherein, when the developing cartridge is moved toward the developing cartridge mounting portion while the developing cartridge side guide portion is engaged with a main body side guide portion, an abutting portion provided to the main body side guide portion and an abutted portion of the developing cartridge side guide portion come into contact with each other so that the developing cartridge side guide portion is moved from the protruding position to the retracted position, and wherein, when the developing cartridge reaches the developing cartridge mounting portion, the developing cartridge side guide portion is positioned at the retracted position.

7. An electrophotographic image forming apparatus according to claim 6, further comprising a pressing member for pressing the developing cartridge so that the developing roller is directed to the electrophotographic photosensitive member, wherein the developing cartridge further comprises:

an urging member for urging the developing cartridge side guide portion elastically from the retracted position to the protruding position;

a locking portion for locking the developing cartridge side guide portion at the retracted position when the developing cartridge side guide portion is moved from the protruding position to the retracted position; and a lock releasing portion for releasing a lock of the locking portion by the lock releasing portion being engaged with an engagement portion provided on the main body side guide portion when the developing cartridge is taken out from the developing cartridge mounting portion, and wherein the developing cartridge side guide portion is locked at the retracted position when the developing cartridge is pressed by the pressing member.

8. An electrophotographic image forming apparatus according to claim 6, further comprising a main body side electric contact for applying a bias to the developing roller, wherein the developing cartridge further comprises a developing bias electric contact for receiving the bias applied to the developing roller from the main body side electric contact, wherein the developing bias electric contact is covered with a cover portion formed in the developing cartridge side guide portion when the developing cartridge side guide portion is positioned at the protruding position, and wherein the developing bias electric contact is exposed from the cover portion of the developing cartridge side guide portion when the developing cartridge side guide portion is positioned at the retracted position.

9. An electrophotographic image forming apparatus to which a plurality of process cartridges are detachably mounted for forming an image on a recording medium, the electrophotographic image forming apparatus comprising:

main body side guide portions; and a process cartridge mounting portion to which the plurality of process cartridges are detachably mounted side-by-side, each of the plurality of process cartridges comprising:

an electrophotographic photosensitive drum;

first process cartridge side guide portions provided at one end and the other end, respectively, in a longitudinal direction of the electrophotographic photosensitive drum, for engaging with the main body side guide portions to regulate a movement locus of a process cartridge when the process cartridge is mounted to an apparatus main body of the electrophotographic image forming apparatus; and protruding portions provided at the one end and the other end, respectively, in the longitudinal direction of the electrophotographic photosensitive drum, wherein the process cartridge is mounted to the apparatus main body in a mounting direction orthogonal to the longitudinal direction of the electrophotographic photosensitive drum with the electrophotographic photosensitive drum being a leading edge, wherein the protruding portions are second process cartridge side guide portions, which protrude on a downstream side further than the electrophotographic photosensitive drum in the mounting direction, and engage with the main body side guide portions to regulate the movement locus of the process cartridge when the process cartridge is mounted to the process cartridge mounting portion, wherein one of the first process cartridge side guide portions and a corresponding one of the second process cartridge side guide portions are an integrated process cartridge side guide portion, wherein the process cartridge side guide portion is movable between a protruding position at which the process cartridge side guide portion protrudes on the downstream side further than the electrophotographic photosensitive drum in the mounting direction and a retracted position at which the process cartridge side guide portion is retracted on an upstream side further than a leading edge of the electrophotographic photosensitive drum in the mounting direction, wherein the process cartridge side guide portion is positioned at the protruding position when the process cartridge is taken out from the electrophotographic image forming apparatus main body, wherein, when the process cartridge is moved toward the process cartridge mounting portion while the process cartridge side guide portion is engaged with a main body side guide portion, an abutting portion provided on the main body side guide portion and an abutted portion of the process cartridge side guide portion come into contact with each other so that the process cartridge side guide portion is moved from the protruding position to the retracted position, and wherein, when the process cartridge reaches the process cartridge mounting portion, the process cartridge side guide portion is positioned at the retracted position.

10. An electrophotographic image forming apparatus according to claim 9, further comprising a pressing member for pressing the process cartridge so that the electrophotographic photosensitive drum is directed to a transfer member on which a developer image formed on the electrophotographic photosensitive drum is transferred, wherein the process cartridge further comprises:

an urging member for urging the process cartridge side guide portion elastically from the retracted position to the protruding position;

a locking portion for locking the process cartridge side guide portion at the retracted position when the process cartridge side guide portion is moved from the protruding position to the retracted position; and a lock releasing portion for releasing a lock of the locking portion by the lock releasing portion being engaged with an engagement portion provided on the main body side guide portion when the process cartridge is taken out from the process cartridge mounting portion, and wherein the process cartridge side guide portion is locked at the retracted position when the process cartridge is pressed by the pressing member.

* * * * *